US005153108A

United States Patent [19]

Ishikawa et al.

[11] Patent Number: 5,153,108

[45] Date of Patent: Oct. 6, 1992

[54] METHOD OF PROCESSING SILVER HALIDE COLOR PHOTOGRAPHIC MATERIALS

[75] Inventors: Takatoshi Ishikawa; Kazuaki Yoshida, both of Kanagawa, Japan

[73] Assignee: Fuji Photo Film Co., Ltd., Kanagawa, Japan

[21] Appl. No.: 789,541

[22] Filed: Nov. 8, 1991

Related U.S. Application Data

[63] Continuation of Ser. No. 416,636, Oct. 3, 1989, abandoned.

[30] Foreign Application Priority Data

Oct. 3, 1988 [JP] Japan ..... 63-249255

[51] Int. Cl.[5] ..... G03C 11/00

[52] U.S. Cl. ..... 430/372; 430/380; 430/376; 430/382; 430/522

[58] Field of Search ..... 430/522, 376, 380, 382, 430/372

[56] References Cited

U.S. PATENT DOCUMENTS

| | | | |
|---|---|---|---|
| 4,774,167 | 9/1988 | Koshimizu et al. . | |
| 4,800,153 | 1/1989 | Morimoto et al. . | |
| 4,801,521 | 1/1989 | Ohki et al. | 430/380 |
| 4,851,326 | 7/1989 | Ishikawa et al. | 430/380 |
| 4,853,321 | 8/1989 | Momoki et al. | 430/380 |
| 4,876,174 | 10/1989 | Ishikawa et al. | 430/380 |
| 4,880,728 | 11/1989 | Ishikawa et al. | 430/380 |
| 4,965,175 | 10/1990 | Fujimoto et al. | 430/376 |
| 4,996,138 | 2/1991 | Murai et al. | 430/522 |
| 5,001,042 | 3/1991 | Hasebe | 430/380 |
| 5,004,675 | 4/1990 | Yoneyama et al. | 430/376 |

FOREIGN PATENT DOCUMENTS

| | | | |
|---|---|---|---|
| 0312984 | 4/1989 | European Pat. Off. | 430/380 |
| 11105948 | 4/1989 | Japan . | |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A method for processing a silver halide color photographic material comprising at least one silver halide emulsion layer, which comprises developing the silver halide color photographic material with a color developer containing at least one aromatic primary amine color developing agent, wherein the photographic material contains (a) at least one high silver chloride content emulsion layer with a silver chloride content of 80 mol % or more, and (b) a compound of formula (I):

(I)

wherein $R_1$ and $R_2$ each represents $-COOR_5$, $-COR_5$ —CN or a halogenated methane $R_3$ and $R_4$ each represents a hydrogen atom or an unsubstituted or substituted alkyl group; $R_5$ and $R_6$ each represents a hydrogen atom, an unsubstituted or substituted alkyl group or an unsubstituted or substituted aryl group; $Q_1$ and $Q_2$ each represents an aryl group; $X_1$ and $X_2$ each represents a chemical bond or a divalent linking group; $Y_1$ and $Y_2$ each represents a sulfo group or a carboxy group; $L_1$, $L_2$ and $L_3$ each represents a methine group; $m_1$ and $m_2$ each represents 0, 1, or 2; n represents 0, 1 or 2; $p_1$ and $p_2$ each represents 0, 1, 2, 3 or 4; $s_1$ and $s_2$ each represents 1 or 2; and $t_1$ and $t_2$ each represents 0 or 1; provided that the total of $m_1$, $p_1$ and $t_1$ and the total of $m_2$, $p_2$ and $t_2$ must not be 0 at the same time;

and the color developer contains a chloride ion in an amount of from $3.5\times10^{-2}$ to $1.5\times10^{-1}$ mol/liter and bromide ion in an amount of from $3.0\times10^{-5}$ to $1.0\times10^{-3}$ mol/liter.

6 Claims, No Drawings

METHOD OF PROCESSING SILVER HALIDE COLOR PHOTOGRAPHIC MATERIALS

This is a Continuation of application Ser. No. 07/416,636 filed Oct. 3, 1989, abandoned.

FIELD OF THE INVENTION

The present invention relates to a method for processing a silver halide color photographic material and, more precisely, to a method for processing a high silver chloride silver halide photographic material which has excellent developability and desilvering property. It further relates to a method for processing such a photographic material to give a processed material with an improved white background portion with less stain even by rapid processing.

BACKGROUND OF THE INVENTION

Recently, in photographic processing of color photographic materials, shortening of the processing time is desired to bring about a shortening of the period for delivery of finished photographs and a reduction in labour in the photo-processing laboratory. As a means of shortening the processing time in the respective processing steps, elevating the processing temperature and increasing the replenisher to each step have been generally used. In addition, other various methods of strengthening stirring or adding various accelerators have heretofore been proposed.

Above all, a method of processing a color photographic material containing a silver chloride emulsion in place of a silver bromide type emulsion or silver iodide type emulsion which has hitherto widely been used is noticeable for the purpose of accelerating color development and/or reducing the amount of the replenisher. For instance, International Patent Application Laid-Open No. W087-04534 illustrates a method of rapid processing of a high silver chloride color photographic material with a color developer substantially not containing sulfite ion and benzyl alcohol.

However, the above rapid processing method was found to have some serious problems, especially in the continuous processing procedure, in that the non-colored portion (hereinafter referred to as "white background portion") in the processed color photographic material is stained (colored in the white background portion) so that it becomes dirty, and further the image portion (colored portion) is insufficiently desilvered so that the color reproducibility and the saturation are low.

As the main reasons for causing the abovementioned stains, there are mentioned the following points:

(1) The non-exposed portion is silver-developed or fogged.

(2) The oxidized products (e.g., tar component, etc.) of the color developing agent and the like adhere to the photographic material being processed to cause color staining on the material.

(3) After the color development step, the developing agent is carried over into the oxidation bath (bleaching bath or bleach-fixation bath) where the agent is oxidized to thereby be discriminatingly coupled with the coupler existing in the photographic material being processed to form a dye therein. This is a so-called bleaching fog.

(4) Because of insufficient washing of the antiirradiation dye and sensitizing dye from the processed photographic material, the colors of the dyes still remain in the processed material. This is a so called color-retention.

Accordingly, prevention of stain in the white background portion could be attained only after the stains caused by the above-mentioned points (1) through (4) be totally improved and prevented.

On the other hand, the desilvering failure caused by high silver chloride emulsions would result from the following reasons:

That is, a silver chloride emulsion has a higher silver ion-solubility than a silver iodobromide or silver chlorobromide emulsion and, as a result, the development of a silver chloride emulsion may finish in a short period of time because of extreme acceleration of the solution physical development of the emulsion. However, the developed silver thus formed is hardly in the form of filaments, but nearly spherical and large developed silver grains having a small surface area would be formed and, as a result, the desilvering speed would be lowered.

As a means of overcoming the above-mentioned problems, methods of using an organic antifoggant are known, for example, as described in JP-A-58-95345 and JP-A-59-232342 (the term "JP-A" as used herein means an "unexamined published Japanese patent application"), where a high silver chloride color photographic material is processed by continuous rapid processing whereupon fluctuation of the photographic characteristic (especially anti-fogging property) of the photographic material being processed is reduced by the action of the organic antifoggant. However, it has been found that incorporation of such an organic antifoggant into the photographic material would often cause a lowering of the maximum density of the image formed in the material and would often cause desilvering failure (unsufficient desilvering) in the processing step. Accordingly, the method of using such an organic antifoggant could not be said favorable.

On the other hand, JP-A-61-70552 illustrates a method of processing a high silver chloride color photographic material by a low-replenishment system where a replenisher is added to the development bath in such an amount that the developer does not overflow from the development bath during the processing. JP-A-63-106655 illustrates a method of processing a silver halide color photographic material in which the silver halide emulsion layer has a high silver chloride content, with a color developer containing a hydroxyamine type compound and at least $2\times10^{-2}$ mol/l of a chloride, with an object of providing a stabilized processing.

However, both of the above methods were not effective for preventing the generation of stains and were unsatisfactory for improving the desilverability of the processed materials, and thus were not satisfactory techniques.

SUMMARY OF THE INVENTION

A first object of the present invention is to provide a method of processing a high silver chloride color photographic material by rapid processing to give a color image with no stain on the material processed.

A second object of the present invention is to provide a method of processing a high silver chloride color photographic material by rapid processing to give a color image having an excellent photographic property with a high maximum density and a low minimum density, whereupon fluctuation of the photographic characteristic (especially, the minimum density) is noticeably retarded even in continuous processing.

A third object of the present invention is to provide a method of processing a high silver chloride color photographic material, in which the residual silver amount in the processed material is small and the desilverability of the material has been improved.

It has been found in accordance with the present invention that the above-mentioned and other objects can effectively be attained by a method for processing a silver halide color photographic material comprising at least one silver halide emulsion layer, which comprises developing the photographic material with a color developer containing at least one aromatic primary amine color developing agent, wherein the photographic material contains (a) at least one high silver chloride content emulsion layer with a silver chloride content of 80 mol% or more, and (b) a compound of formula (I):

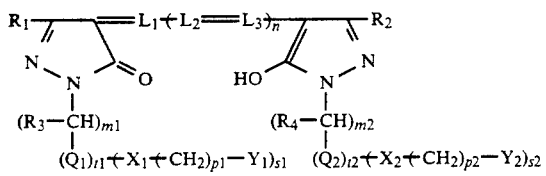

(I)

wherein $R_1$ and $R_2$ each represents $-COOR_5$, $-CON(R_6)-R_5$, $-COR_5$ —CN or a halogenated methane; $R_3$ and $R_4$ each represents a hydrogen atom or an unsubstituted or substituted alkyl group; $R_5$ and $R_6$ each represents a hydrogen atom, an unsubstituted or substituted alkyl group having 1 to 10, preferably 1 to 5 carbon atoms or an unsubstituted or substituted aryl group having 6 to 10 carbon atoms; $Q_1$ and $Q_2$ each represents an unsubstituted or substituted aryl group having 6 to 10 carbon atoms; $X_1$ and $X_2$ each represents a chemical bond or a divalent linking group; $Y_1$ and $Y_2$ each represents a sulfo group or a carboxy group; $L_1$, $L_2$ and $L_3$ each represents a methine group; $m_1$ and $m_2$ each represents 0, 1, or 2; n represents 0, 1 or 2; $p_1$ and $p_2$ each represents 0, 1, 2, 3 or 4; $s_1$ and $s_2$ each represents 1 or 2; and $t_1$ and $t_2$ each represents 0 or 1; provided that the total of $m_1$, $p_1$ and $t_1$ and the total of $m_2$, $p_2$ and $t_2$ must not be 0 at the same time;

and the color developer contains chloride ion in an amount of from $3.5\times10^{-2}$ to $1.5\times10^{-1}$ mol/liter and bromide ion in an amount of from $3.0\times10^{-5}$ to $1.0\times10^{-3}$ mol/liter.

DETAILED DESCRIPTION OF THE INVENTION

Chloride ion is well known as one of the conventional antifoggants, but the effect thereof is poor. Even though a large amount of chloride ion is used, an increase of fog with continuous processing and streaky fogs which are generated in processing with an automatic developing machine could not completely be prevented, but rather the use of such a large amount of chloride ion would have a bad influences on the processing of photographic materials, for example, the development would be retarded or the maximum density would be lowered.

Bromide ion is also well known as one of the conventional antifoggants. Where the amount of the bromide ion to be used is properly controlled, fogging in continuous processing during development could be prevented. However, the bromide ion also inhibits the development in the continuous processing of photographic materials thereby to lower the maximum density and the sensitivity of the materials. Accordingly, bromide ion could not be put to practical use.

On the other hand, various dyes are incorporated into silver halide color photographic materials for the purpose of preventing irradiation in printing or for the purpose of elevating the safety to a so-called safe light, the dyes not lowering the sensitivity of the materials, not worsening the latent image-preservability thereof and not having any other bad influences on the photographic characteristics of the materials and additionally the dyes not causing stains (such as color-retention stains) in the processed materials to lower the quality thereof.

These dyes often color the processed color photographic materials to cause undesirable stains therein, where the materials are insufficiently washed after being processed or where the dyes are dissolved out into the color developer, the rinsing water and/or the stabilizing solution to inconveniently color the processing solutions, and such would be a serious problem especially in rapid processing. In order to prevent such stains (color stains) from being caused by the dyes, it is generally desired to employ dyes that can be decomposed with alkalis or reducing agents in the color developer to give colorless products. Additionally, in rapid processing, washing of the dyes and decoloration thereof in the color developer are to be important techniques.

In accordance with the present invention, a determined amount of chloride ion and a determined amount of bromide ion are incorporated into the color developer to be employed in the method of the present invention, whereby fog during development has successfully been inhibited without lowering the maximum density. Additionally, the effect of washing the dyes of the above-mentioned formula (I) in the color developer may be accelerated even in rapid processing, and releasing of the sensitizing dyes from the photographic material being processed may be accelerated. As a result, stain may be prevented and, for example, a photograph with an excellent white background portion can be obtained in accordance with the present invention.

In particular, it is especially noted that the desilverability in the method of the present invention has extremely been improved because of the incorporation of bromide ion of a determined concentration and chloride ion of a determined concentration into the color developer to be employed and of the incorporation of the dye of the above-mentioned formula (I) into the photographic material to be processed by the method of the present invention. Above all, it is particularly noted that the above effect can be attained by the employment of the dye having the structure of formula (I).

Now, the present invention will be explained in detail hereunder.

The silver halide emulsion which constitutes the photographic material to be processed by the method of the present invention substantially comprises silver chloride. The wording "substantially comprises silver chloride" as referred to herein means that the content of silver chloride to the total silver halide is 80 mol% or more, preferably 95 mol% or more, more preferably 98 mol% or more. In view of the rapid processability of the material, the silver chloride content is preferably as high as possible.

The amount of silver which is coated on the silver halide photographic material of the present invention is preferably 0.80 g/m$^2$ or less, in view of the rapid processability high desilverability and sufficient stainpreventability. Such merits are considered to be caused by not only the reduction of the silver amount in the material but also the reduction of the film thickness of the material. The amount of silver coated on the material is more preferably 0.75 g/m$^2$ or less, especially preferably 0.65 g/m$^2$ or less. In view of the image density, however, it is preferably 0.30 g/m$^2$ or more.

In accordance with the present invention, it is necessary that the color developer contains chloride ion in an amount Of from $3.5\times10^{-2}$ to $1.5\times10^{-1}$ mol/liter, preferably from $4\times10^{-2}$ to $1\times10^{-1}$ mol/liter. If the chloride ion concentration in the color developer is more than $1.5\times10^{-1}$ mol/liter, the developer would have the drawback that the developability is retarded, and the object of the present invention to attain rapid processing and to obtain a high maximum density in the processed material could not be attained. On the other hand, if it is less than $3.5\times10^{-2}$ mol/liter, stain could not be prevented and, in addition, fluctuation of the photographic property (especially, the minimum density) would be large with continuous processing and the amount of the residual silver would be large. Accordingly, the object of the present invention also could not be attained.

In accordance with the present invention, it is further necessary that the color developer contains bromide ion in an amount of from $3.0\times10^{-5}$ mol/liter to $1.0\times10^{-3}$ mol/liter, preferably from $5.0\times10^{-5}$ mol/liter to $5\times10^{-4}$ mol/liter. If the bromide ion concentration is more than $1\times10^{3}$ mol/liter, the development would be retarded and the maximum density and sensitivity would lower. However, if it is less than $3.0\times10^{-5}$ mol/liter, prevention of stain could not be effected and, in addition, fluctuation of the photographic property (especially the minimum density) and desilvering failure with continuous processing could not be prevented. Accordingly, the objects of the present invention also could not be attained.

The chloride ion and bromide ion may be added directly to the developer or, alternatively, they may be dissolved out from the photographic material during processing.

Where the ions are directly added to the color developer, there are mentioned sodium chloride, potassium chloride, ammonium chloride, nickel chloride, magnesium chloride, manganese chloride, calcium chloride and cadmium chloride as chloride ion-donating substances. Among them, sodium chloride and potassium chloride are preferred.

The ions may also be introduced into the developer in the form of counter ions of the brightening agents which are added to the developer. As substances for donating bromide ion, there are mentioned sodium bromide, potassium bromide, ammonium bromide, lithium bromide, calcium bromide, magnesium bromide, manganese bromide, nickel bromide, cadmium bromide, cerium bromide and thallium bromide. Among them, potassium bromide and sodium bromide are preferred.

Where the ions are to be dissolved out from the photographic materials during development, both may be derived from the emulsions or from other sources.

Next, formula (I) which represents the compounds which are incorporated in the photographic materials of the present invention will be explained in detail hereunder.

In formula (I), $R_1$ and $R_2$ independently represent $-COOR_5$, $$-\underset{\underset{R_6}{|}}{CON}-R_5,$$

$-COR_5$ or $-CN$.

$R_3$ and $R_4$ each represents a hydrogen atom, an unsubstituted alkyl group or a substituted alkyl group (e.g., methyl, ethyl, butyl, hydroxyethyl). $R_5$ and $R_6$ each represents a hydrogen atom, an unsubstituted alkyl or substituted alkyl group (e.g., methyl, ethyl, butyl, hydroxyethyl, phenethyl), or an unsubstituted aryl or substituted aryl group (e.g., phenyl, hydroxyphenyl).

$Q_1$ and $Q_2$ each represents an unsubstituted or substituted aryl group (e.g., phenyl, naphthyl). $X_1$ and $X_2$ each represents a chemical bond or a divalent linking group (e.g., —S—, —O—, —Se—, —NH—, —$CH_2$—); and $Y_1$ and $Y_2$ each represents a sulfo group or a carboxyl group. $L_1$, $L_2$ and $L_3$ each represents a methine group. $m_1$ and $m_2$ each represents 0, 1 or 2; n represents 0, 1 or 2; $p_1$ and $p_2$ each represents 0, 1, 2, 3 or 4; $s_1$ and $s_2$ each represents 1 or 2; and $t_1$ and $t_2$ each represents 0 or 1; provided that the total of $m_1$, $p_1$ and $t_1$, and the total of $m_2$, $p_2$ and $t_2$ must not be 0 at the same time.

Specific examples of the compounds of formula (I) are set forth below by compounds (I-1) to (I-37), which, however, are not limitative.

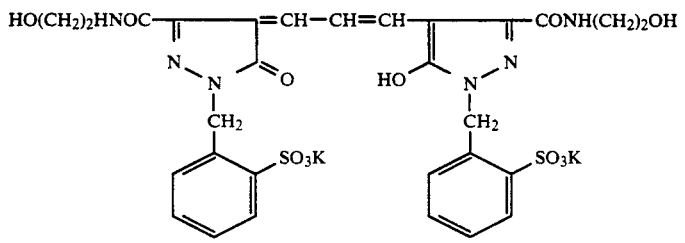

(I-1)

-continued
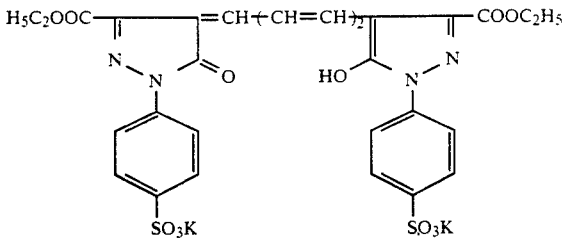
(I-2)
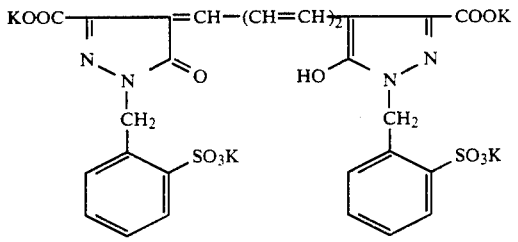
(I-3)
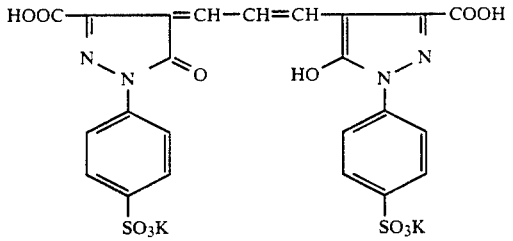
(I-4)
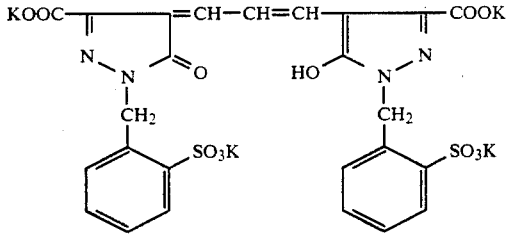
(I-5)
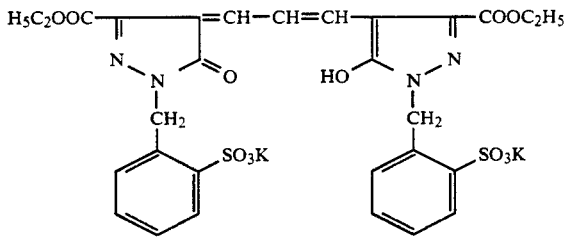
(I-6)
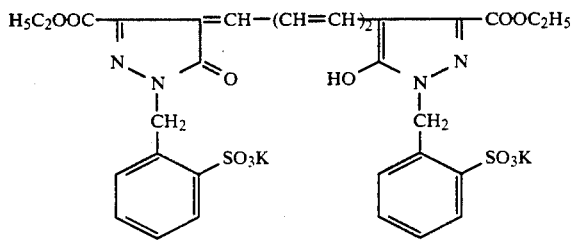
(I-7)

-continued
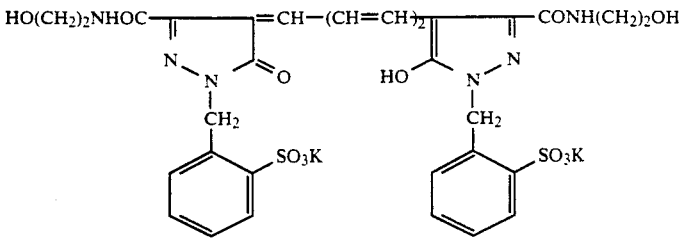
(I-8)
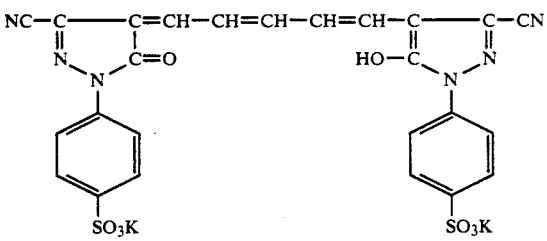
(I-9)
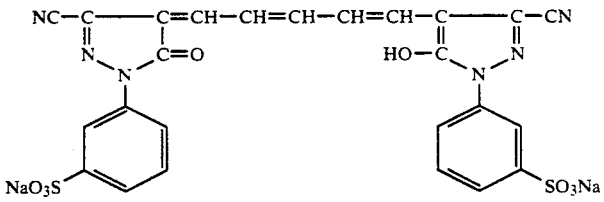
(I-10)
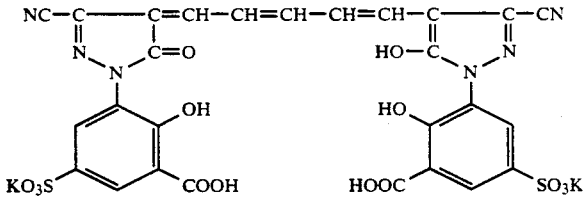
(I-11)
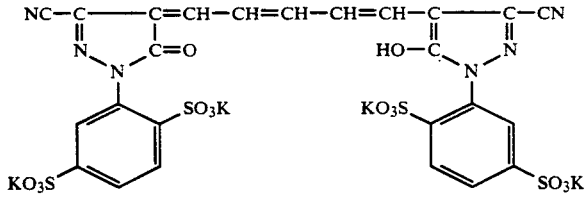
(I-12)
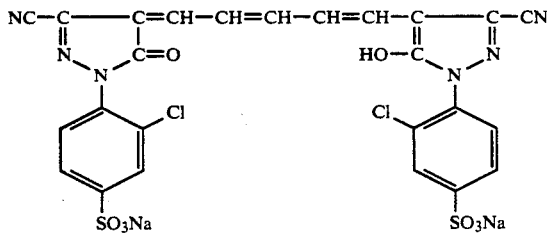
(I-13)
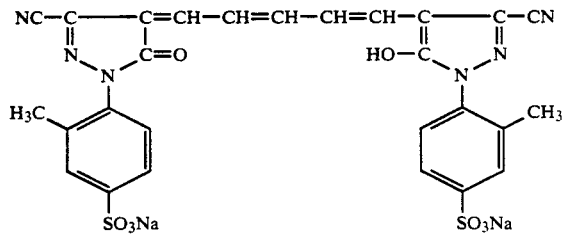
(I-14)

-continued
(I-15)
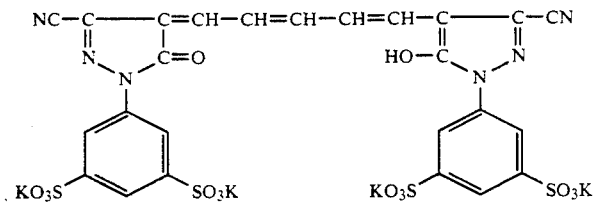
(I-16)
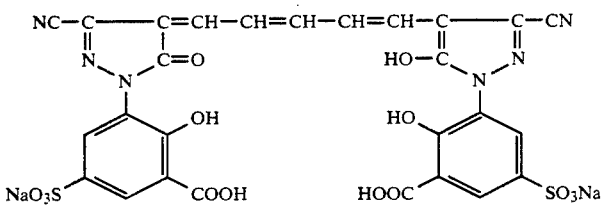
(I-17)
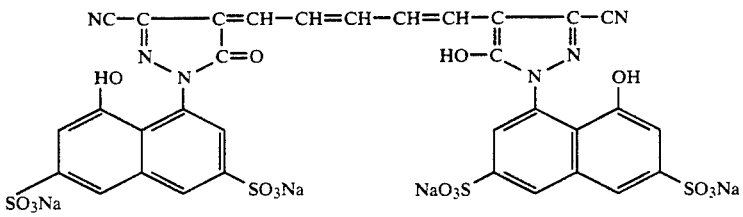
(I-18)
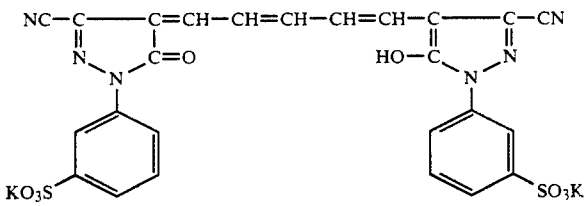
(I-19)
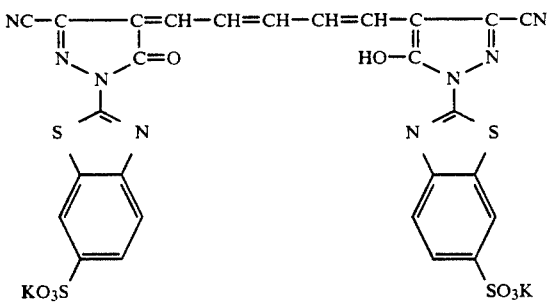
(I-20)
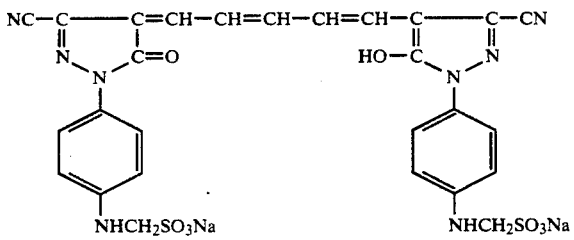
(I-21)
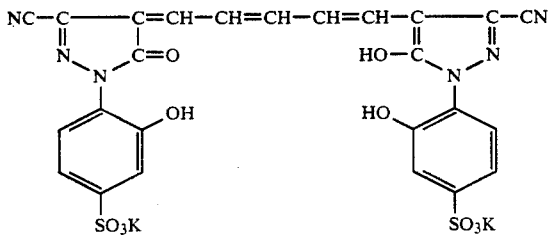

-continued
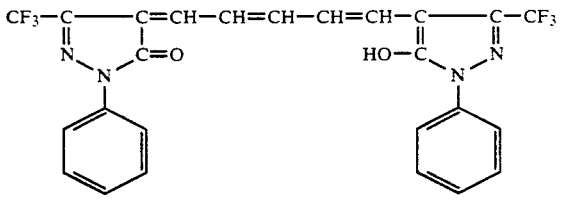
(I-22)
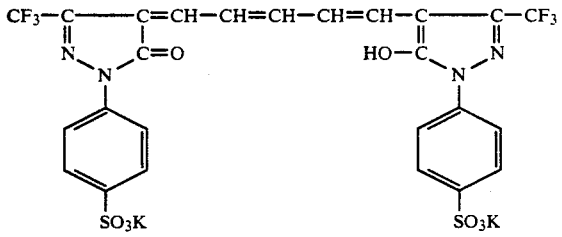
(I-23)
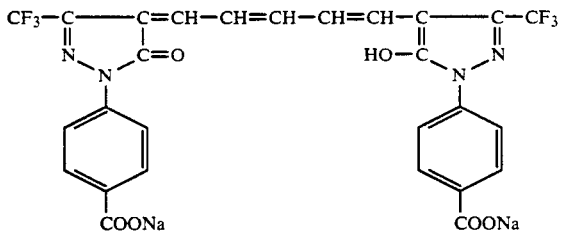
(I-24)
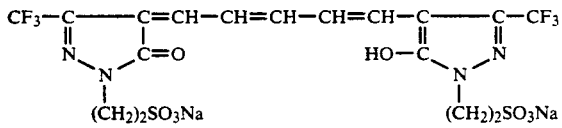
(I-25)
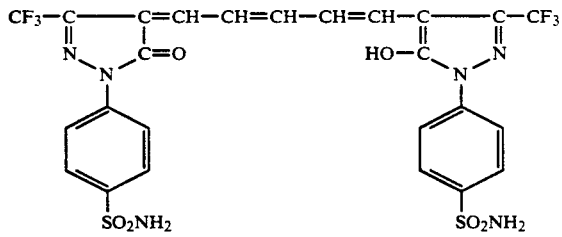
(I-26)
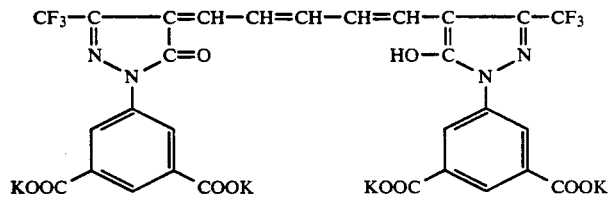
(I-27)
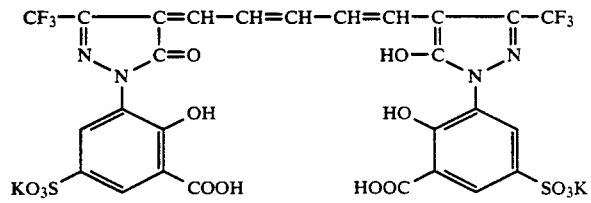
(I-28)

-continued
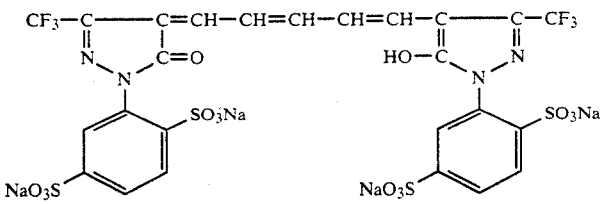
(I-29)
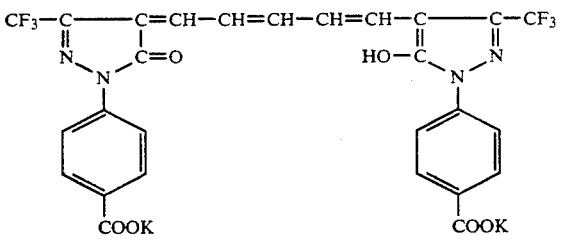
(I-30)
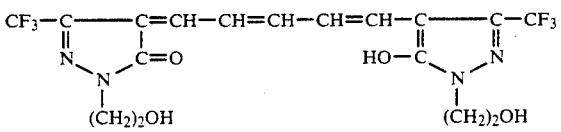
(I-31)
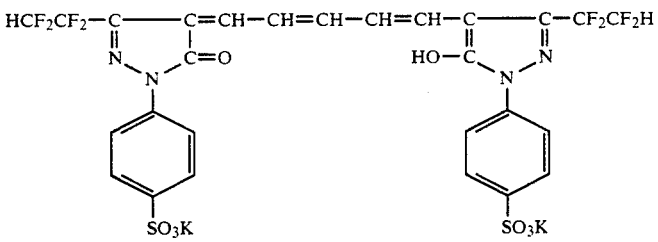
(I-32)
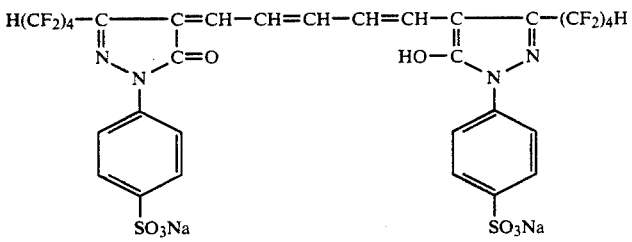
(I-33)
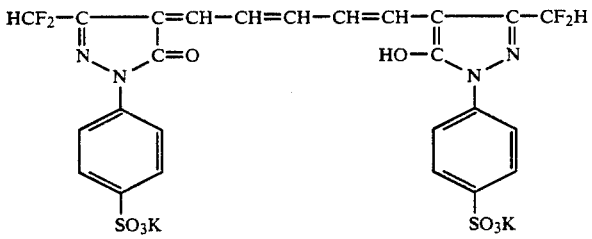
(I-34)
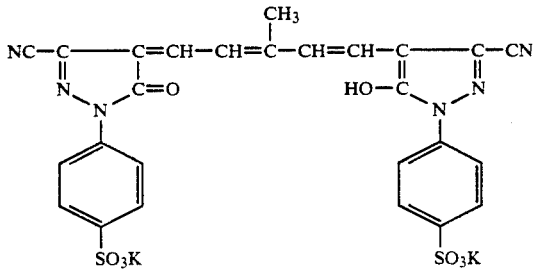
(I-35)

-continued

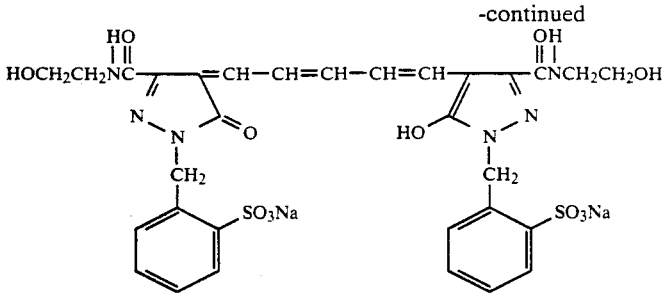

(I-36)

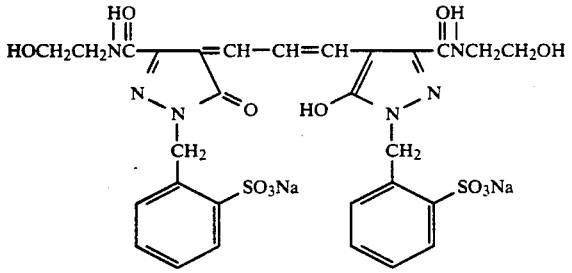

(I-37)

The amount of the compound of formula (I) to be incorporated into the color photographic material is preferably from 0.0001 g to 1 g, more preferably form 0.0005 g to 0.1 g, per $m^2$ of the material.

The dyes of formula (I) are generally used as an anti-irradiation dye, and thus compounds (I-1) to (I 37) are anti-irradiation dyes. In general, the dyes of formula (I) are incorporated into the silver halide emulsion layer and especially preferably into the green-sensitive emulsion layer or red-sensitive emulsion layer.

In accordance with the present invention, it is preferred that the color developer does not substantially contain sulfite ion in view of maintaining the processing stability in continuous processing and of preventing streaky pressure marks. For the purpose of preventing deterioration of the color developer during processing, various physical means are employed, for example, the developer is not used for a period of too long a time, a floating lid is used so as to prevent the influence of aerial oxidation and the opening area of the developer tank is reduced, or various chemical means are also employed, for example, the temperature of the developer is lowered and an organic preservative is added to the processing solution. Above all, employment of organic preservatives is advantageous as being simple.

The organic preservative as referred to herein means any and every organic compound which can be added to the processing solution for color photographic materials thereby to retard the deteriorating speed of the aromatic primary amine color developing agent contained in the developer. That is to say, such organic preservatives include organic compounds having a function of preventing aerial oxidation of color developing agents. Above all, effective organic preservatives are hydroxylamine derivatives excluding unsubstituted hydroxylamine (herein after referred to as "hydroxylamine derivatives"), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and condensed ring type amines. These are described in JP-A-63-146041, JP-A 63-170642, JP-A-63-4235, JP-A-63-30845, JP-A 63-21647, JP-A-63-44655, JP-A-63-53551, JP-A-63-43140, JP-A-63-56654, JP-A-63-58346, JP-A-63-43138, JP-A-63-44657, JP-A-63-44656, and JP-A-52-143020, U.S. Pat. Nos. 3,615,503 and 2,494,903 and JP-B-48-30496. (The term "JP-B" as referred to herein means an "examined Japanese patent publication".)

For the preferred organic preservative, the constitutional formulae thereof as well as specific examples of the compounds thereof will be mentioned below, which, however, are not intended to restrict the scope of the present invention.

The amount of the organic preservative compound to be added to the color developer is desirably from 0.005 mol/liter to 0.5 mol/liter, preferably from 0.03 mol/liter to 0.1 mol/liter.

In particular, addition of hydroxylamine derivatives and/or hydrazine derivatives is preferred.

As hydroxylamine derivatives, those of the following formula (II) are preferred.

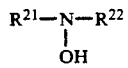

(II)

wherein $R^{21}$ and $R^{22}$ each represents a hydrogen atom, an unsubstituted or substituted alkyl group, an unsubstituted or substituted alkenyl group, an unsubstituted or substituted aryl group or an unsubstituted or substituted hetero-aromatic group. $R^{21}$ and $R^{22}$ must not be hydrogens at the same time, and they may be bonded to each other to form a hetero-ring together with the adjacent nitrogen atom. The cyclic structure of the hetero ring is 5-membered or 6-membered, and it is composed of carbon, hydrogen, halogen, oxygen, nitrogen and/or sulfur atoms. It may be either saturated or unsaturated.

Preferably, $R^{21}$ and $R^{22}$ each represents an alkyl group or an alkenyl group, and the group preferably has from 1 to 10 carbon atoms, especially preferably from 1 to 5 carbon atoms. As the nitrogen-containing hetero-ring to be formed of $R^{21}$ and $R^{22}$ as bonded to each other, there are mentioned a piperidyl group, a pyrrolidyl group, an N-alkylpiperazyl group, a morpholyl group, an indolinyl group and a benzotriazole group.

Preferred substituents on $R^{21}$ and $R^{22}$ are a hydroxyl group, an alkoxy group, an alkyl sulfonyl group, an arylsulfonyl group, an amido group, a carboxyl group, a cyano group, a sulfo group, a nitro group and an amino group.

Examples of the compounds of the formula (II) are as follows:

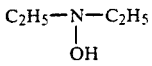
II-1

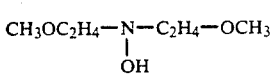
II-2

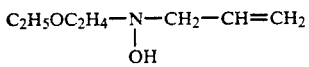
II-3

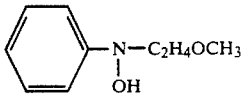
II-4

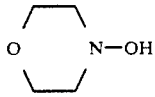
II-5

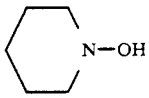
II-6

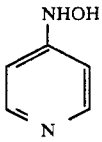
II-7

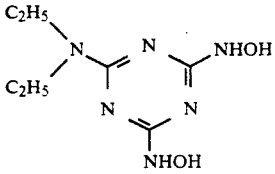
II-8

As hydrazines and hydrazides, those of the following formula (III) are preferred.

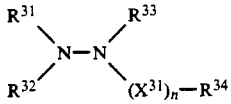
(III)

wherein $R^{31}$, $R^{32}$ and $R^{33}$ each represents a hydrogen atom, or a substituted or unsubstituted alkyl, aryl or heterocyclic group; and R34 represents a hydroxyl group, a hydroxylamino group, or a substituted or unsubstituted alkyl, aryl, heterocyclic, alkoxy, aryloxy, carbamoyl or amino group. The heterocyclic group is a 5-membered or 6-membered group and is composed of C, H, O, N, S and/or halogen atoms. It may be either saturated or unsaturated. $X^{31}$ represents a divalent group selected from —CO—, $—SO_2—$ or

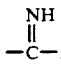

and n represents 0 or 1. In particular, when n is 0, $R^{34}$ represents a group selected from an alkyl group, an aryl group and a heterocyclic group, or $R^{33}$ and $R^{34}$ may together form a hetero-ring.

In formula (III), $R^{31}$, $R^{32}$ and $R^{33}$ preferably represent hydrogen atoms or alkyl groups having 1 to 10 carbon atoms, and more preferably $R^{31}$ and $R^{32}$ are hydrogen atoms.

In formula (III), $R^{34}$ preferably represents an alkyl group, an aryl group, an alkoxy group, a carbamoyl group or an amino group, and more preferably it is an unsubstituted alkyl group or a substituted alkyl group. Preferred substituents for the alkyl group are a carboxyl group, a sulfo group, a nitro group, an amino group and a sulfono group. $X^{31}$ preferably represents —CO— or $—SO_2—$, and more preferably, it is —CO—.

Examples of compounds of formula (III) are as follows:

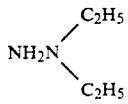
III-1

$NH_2NH(CH_2)_4SO_3H$ III-2

$NH_2NH(CH_2)_2OH$ III-3

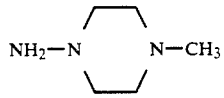
III-4

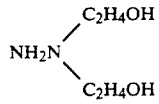
III-5

$NH_2NHCOCH_3$ III-6

$NH_2NHCOOC_2H_5$ III-7

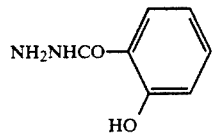
III-8

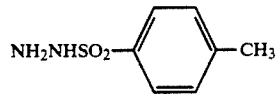
III-9

$NH_2NHCONH_2$ III-10

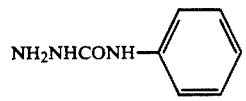
III-11

$NH_2NHSO_3H$ III-12

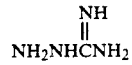
III-13

$NH_2NHCOCONHNH_2$ III-14

$NH_2NHCH_2CH_2CH_2SO_3H$ III-15

-continued

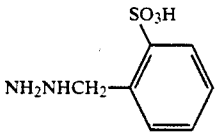

III-16

$NH_2NHCH_2CH(C_4H_9(n))COOH$ III-17

$NH_2NHCH_2CH_2COOH$ III-18

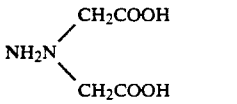

III-19

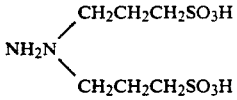

III-20

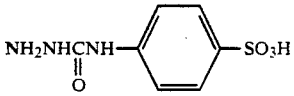

III-21

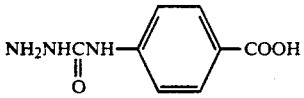

III-22

Employment of a compound of the above-mentioned formula (II) or (III) and an amine compound of the following formula (IV) or (V) in combination is more preferred for the purpose of improving the stability of the color developer and especially for improving the stability of the color developer in continuous processing.

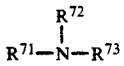

(IV)

wherein $R^{71}$, $R^{72}$ and $R^{73}$ each represents a hydrogen atom, an alkyl group, an alkenyl group, an aryl group, an aralkyl group or a heterocyclic group. In formula (IV), $R^{71}$ and $R^{72}$; $R^{71}$ and $R^{73}$; or $R^{72}$ and $R^{73}$ may be bonded to each other to form a nitrogen-containing hetero-ring.

$R^{71}$, $R^{72}$ and $R^{73}$ may have substituent(s). Especially preferably, $R^{71}$, $R^{72}$ and $R^{73}$ each is a hydrogen atom or an alkyl group. As the substituent(s}for these groups, there are mentioned a hydroxyl group, a sulfo group, a carboxyl group, a halogen atom, a nitro group and an amino group.

Examples of compounds of formula (IV) are mentioned below.

$N(CH_2CH_2OH)_3$ IV-1

$H_2NCH_2CH_2OH$ IV-2

$HN(CH_2CH_2OH)_2$ IV-3

$C_7H_{15}N(CH_2CH(OH)CH_2OH)_2$ IV-4

-continued

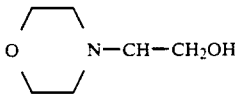

IV-5

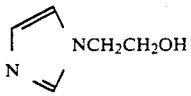

IV-6

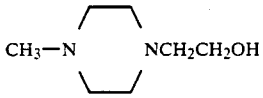

IV-7

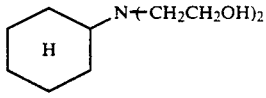

IV-8

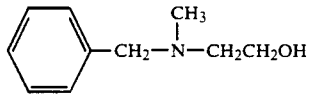

IV-9

$(HOCH_2CH_2)_2NCH_2CH_2SO_2CH_3$ IV-10

$HN(CH_2COOH)_2$ IV-11

$HOOCCH_2CH_2CH(NH_2)COOH$ IV-12

$H_2HCH_2CH_2SO_2NH_2$ IV-13

$(C_2H_5)_2N-CH_2CH_2OCH_2CH_2OH$ IV-14

$H_2N-C(CH_2OH)_3$ IV-15

$HOCH_2CH(NH_2)COOH$ IV-16

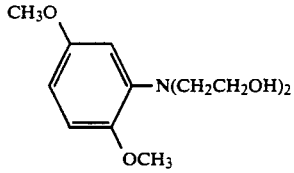

IV-17

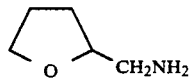

IV-18

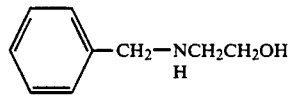

IV-19

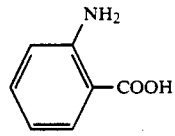

IV-20

-continued (V)

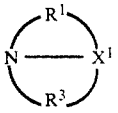

wherein X represents a trivalent atomic group necessary for completing the condensed ring; and $R^1$ and $R^2$ each represents an alkylene group, an arylene group, an alkenylene group or an aralkylene group, and $R^1$ and $R^2$ may be the same or different.

Among the compounds of formula (V), especially preferred are those of the following formulae (V-a) and (V-b);

(V-a)

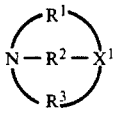

wherein $X^1$ represents

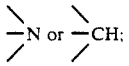

$R^1$ and $R^2$ have the same meanings as those defined in formula (V); and $R^3$ has the same meaning as $R^1$ and $R^2$ of formula (V), or represents

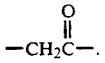

In formula (V-a), $X^1$ is preferably

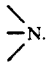

The number of the carbon atoms in the group $R^1$, $R^2$ or $R^3$ is preferably 6 or less, more preferably 3 or less, most preferably 2 or less.

Preferably, $R^1$, $R^2$ and $R^3$ each is an alkylene group or an arylene group; and most preferably, each is an alkylene group.

(V-b)

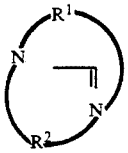

wherein $R^1$ and $R^2$ have the same meanings as those defined in formula (V).

In formula (V-b), the number of carbon atoms in $R^1$ or $R^2$ is preferably 6 or less. Preferably, $R^1$ and $R^2$ each is an alkylene group or an arylene group, and more preferably each is an alkylene group.

Of the compounds of formulae (V-a) and (V-b), especially preferred are the compounds of formula (V-a).

Examples of compounds of formula (V) are mentioned below.

V-1

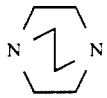

V-2

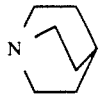

V-3

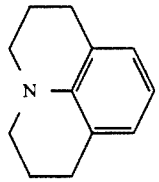

V-4

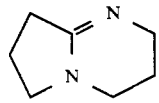

V-5

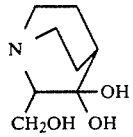

V-6

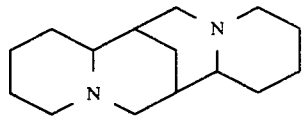

V-7

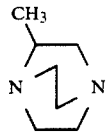

V-8

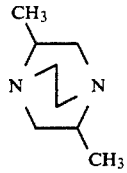

V-9

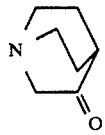

V-10

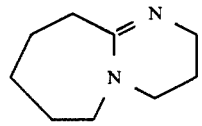

V-11

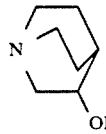

-continued

V-12

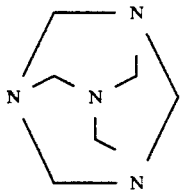

V-13

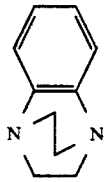

The above-mentioned organic preservatives as represented by the formulae (II) to (V) are available as commercial products, and some of them can be produced by the methods described in JP-A-63-170642 and JP-A-63-239447.

Next, the color developer for use in the present invention will be described below.

The color developer which can be employed in the method of the present invention contains a known aromatic primary amine color developing agent. Preferred examples of the developing agent are p-phenylenediamines, and some typical examples thereof are mentioned below, which, however, are not limitative.

D-1: N,N-diethyl-p-phenylenediamine

D-2: 4-[N-ethyl-N-(β-hydroxyethyl)amino]aniline

D-3: 2-Methyl-4-[N-ethyl-N (β-hydroxyethyl-)amino]aniline

D-4: 4-Amino-3-methyl-N-ethyl-N-(β-methanesulfonamidoethyl)-aniline

The p-phenylenediamines may be in the form of their salts, such as sulfates, hydrochlorides or p-toluene-sulfonates. The amount of the aromatic primary amine developing agent in the developer is preferably from about 0.1 g to about 20 g, more preferably from about 0.5 g to about 10 g, per liter of the developer.

V-14

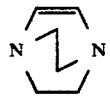

V-15

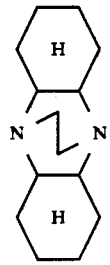

V-16

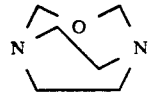

-continued

V-17

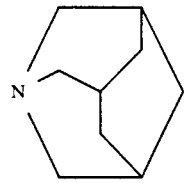

V-18

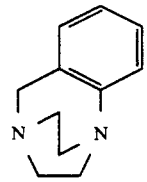

The color developer for use in the present invention has a pH value of preferably from 9 to 12, more preferably from 9 to 11.0. The color developer may contain further compounds of known developer components.

In order to maintain the above-mentioned pH range, various buffers are preferably added to the color developer. As examples of buffers usable for this purpose, there are mentioned sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5 sulfosalicylate) and potassium 5-sulfo-2-hydroxybenzoate (potassium 5-sulfosalicylate).

The amount of the buffer to be added to the color developer is preferably 0.1 mol/liter or more, especially preferably from 0.1 mol/liter to 0.4 mol/liter.

In addition, the color developer may further contain various chelating agents, as an agent for preventing precipitation of calcium or magnesium or for the purpose of improving the stability of the developer.

Examples of chelating agents usable for the purpose are mentioned below, which, however, are not limitative. They include nitrilotriacetic acid, diethylenetriamine pentaacetic acid, ethylenediaminetetraacetic acid, triethylene-tetramine-hexaacetic acid, N,N,N-trimethylene-phosphonic acid, ethylenediamine-N,N,N',N'-tetramethylene-phosphonic acid, 1,3-diamino-2-propanol-tetraacetic acid, transcyclohexanediaminetetraacetic acid, nitrilo-tripropionic acid, 1,2-diaminopropane-tetraacetic acid, hydroxyethylimino-diacetic acid, glycoletherdiamine-tetraacetic acid, hydroxyethylenediamine-triacetic acid, ethylenediamine-orthohydroxyphenylacetic acid, 2-phosphonobutane-1,2,4 tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid and 4-sulfosalicylic acid.

Two or more of such chelating agents may be used in combination, if desired.

The amount of the chelating agent to be added to the color developer may be such that is sufficient for sequestering the metal ions in the color developer. For instance, it may be from 0.1 g to 10 g or so per liter of the color developer.

The color developer may also contain a development accelerator, if desired.

As examples of development accelerators usable in the present invention, there are mentioned thioether compounds described in JP-B-37-16088, JP-B-37 5987, JP-B-38-7826, JP-B-44-12380 and JP-B-45-9019 and U.S. Pat. No. 3,813,247; p-phenylenediamine compounds described in JP-A-52-49829 and JP-A-50-15554; quaternary ammonium salts described in JP-A-50-137726, JP-B-4430074 and JP-A-56-156826 and JP-A 52-43429; p-aminophenols described in U.S. Pat. Nos. 2,610,122 and 4,119,462; amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431 and JP B-42-23883 and U.S. Pat. No. 3,532,501; and other 1-phenyl-3-pyrazolidones, hydrazines, mesoionic compounds and imidazoles. One or more of them may be added to the color developer, if desired.

Preferably, the color developer for use in the present invention does not substantially contain benzyl alcohol. The wording "does not substantially contain benzyl alcohol" means that the color developer contains benzyl alcohol in an amount of 2.0 ml/liter or less and it preferably contains no benzyl alcohol. Where the color developer does not substantially contain benzyl alcohol, fluctuation of the photographic characteristic in continuous processing, especially increase of stain, in small and a more favorable result can be obtained.

In accordance with the present invention, any other desired antifoggant can be added to the color developer, in addition to chloride ion and bromide ion. As such antifoggant, for example, alkali metal halides such as potassium iodide and organic antifoggants can be employed. As examples of organic antifoggants usable for the purpose, there are mentioned nitrogen-containing heterocyclic compounds such as benzotriazole, 6-nitrobenzimidazole, 5-nitroisoinadazole, 5-methylbenzotriazole, 5-nitrobenzotriazole, 5-chloro-benzotriazole, 2-triazolyl-benzimidazole, 2-thiazolylmethylbenzimidazole, indazole, hydroxyazaindolidine and adenine.

The color developer for use in the present invention preferably contains a brightening agent. As the brightening agent are preferred 4,4'-diamino-2,2'-disulfostilbene compounds. The amount thereof to be added to the developer is up to 10 g/liter, preferably from 0.1 to 6 g/liter.

In addition, the color developer may also contain various surfactants, if desired, such as alkylsulfonic acids, aryl-phosphonic acid, aliphatic carboxylic acids or aromatic carboxylic acids.

The processing time with the color developer in accordance with the present invention is from 10 seconds to 120 seconds, preferably from 20 seconds to 60 seconds, in order to remarkably attain the effect of the present invention. The processing temperature is from 33° to 45° C., preferably from 36° to 40° C., whereupon the effect of preventing stains is especially noticeable.

The amount of the replenisher to be replenished to the color developer bath in continuous processing is from 20 to 220 ml, especially preferably from 40 to 140 ml, per $m^2$ of the photographic material being processed, whereupon the effect of the present invention is favorably attained.

In accordance with the present invention, the photographic material is desilvered, after it has been color-developed. The desilvering step generally comprises a bleaching step and a fixation step. Especially preferably, bleaching and fixation are effected simultaneously.

The bleaching solution or bleach-fixing solution to be used in the present invention can contain a rehalogenating agent such as bromides (e.g., potassium bromide, sodium bromide, ammonium bromide), or chlorides (e.g., potassium chloride, sodium chloride, ammonium chloride), or iodides (e.g., ammonium iodide). If desired, the solution may further contain a corrosion-inhibitor, such as one or more inorganic acids or organic acids having a pH buffering capacity or alkali metal or ammonium salts thereof, for example, boric acid, borax, sodium metaborate, acetic acid, sodium acetate, sodium carbonate, potassium carbonate, phosphorous acid, phosphoric acid, sodium phosphate, citric acid, sodium citrate or tartaric acid, as well as ammonium nitrate or guanidine.

The fixing agent to be used in the bleach-fixing solution or fixing solution to be employed in the present invention may be a known bleaching agent, i.e., a water-soluble silver halide solvent, for example, thiosulfates such as sodium thiosulfate or ammonium thiosulfate; thiocyanates such as sodium thiocyanate or ammonium thiocyanate; or thioether compounds or thioureas such as ethylenebis-thioglycolic acid or 3,6-dithiia-1,8-octanediol. These compounds can be used singly or in combination of two or more of them. In addition, a particular bleach-fixing solution comprising a combination of a fixing agent and a large amount of a halide such as potassium iodide, as described in JP-A-55-155354, can also be used. In accordance with the present invention, use of thiosulfates, especially ammonium thiosulfate, is preferred. The amount of the fixing agent in the solution is preferably from 0.3 to 2 mols, more preferably from 0.5 to 1.0 mol, per liter of the solution.

The pH range of the bleach-fixing solution or fixing solution for use in the present invention is preferably from 3 to 8, especially preferably from 4 to 7. If the pH value of the solution is lower than the above range, deterioration of the solution and formation of leuco dyes from the cyan dyes are disadvantageously accelerated although the desilvering property of the solution would be higher. On the contrary, if the pH range is higher than the above range, the desilvering speed would be lowered and stains would be formed.

In order to adjust the pH value of the solution, hydrochloric acid, sulfuric acid, nitric acid, acetic acid, bicarbonates, ammonia, potassium hydroxide, sodium hydroxide, sodium carbonate or potassium carbonate can be added to the solution.

The bleach-fixing solution may further contain other various agents, such as a brightening agent, antifoaming agent or surfactant, as well as an organic solvent such as polyvinyl pyrrolidone or methanol, if desired.

The bleach-fixing solution or fixing solution for use in the present invention may contain a sulfite ionreleasing compound, for example, sulfites (e.g., sodium sulfite, potassium sulfite, ammonium sulfite), bisulfites (e.g., ammonium bisulfite, sodium bisulfite, potassium bisulfite), or metabisulfites (e.g., potassium metabisulfite, sodium meta-bisulfite, ammonium metabisulfite), as a preservative. The compounds are preferably incorporated into the solution in an amount of from about 0.02 to about 0.50 mol/liter, more preferably from about 0.04 to about 0.40 mol/liter, as the sulfite ion. In particular, incorporation of ammonium sulfite is preferred.

As the preservative for the bleach-fixing solution or fixing solution, sulfites are generally employed, but additionally, ascorbic acid, carbonyl-bisulfite adducts, sulfinic acids, carbonyl compounds or sulfinic acids may also be added to the solution.

In addition, a buffer, brightening agent, chelating agent and fungicide can also be added to the solution, if desired.

In accordance with the present invention, the processing time with the bleach-fixing solution is from 10 seconds to 120 seconds, preferably from 20 seconds to 60 seconds. The amount of the replenisher to the bleachfixing step is from 30 ml to 250 ml, preferably from 40 ml to 150 ml, per $m^2$ of the photographic material being processed. Thus, in the present invention, the amount of the replenisher could be reduced as compared to that amount generally used in the bleach fixing step (300 ml to 1000 ml per $m^2$ of the photographic material). In general, a decrease of the replenisher would often be accompanied by an increase of stains or a desilvering failure. However, the method of the present invention is free from such problems and the amount of the replenisher to the bleach-fixing bath can be effected with no trouble.

In accordance with the present invention, the silver halide color photographic materials are generally rinsed in water and/or stabilized, after being desilvered by fixation or bleach-fixation.

The amount of water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages}, the replenishment system of co-current or countercurrent and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic materials of the present invention, the method of reducing calcium and magnesium ions, which is described in JP-A-62-288838, can extremely effectively be used for overcoming this problem. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents,* and *Bactericidal and Fungicidal Techniques to Microorganisms,* edited by Association of Sanitary technique, Japan, and *Encyclopedia of Bactericidal and Fungicidal Agents,* edited by Nippon Bactericide and Fungicide Association, can also be used.

The pH value of the rinsing water to be used for processing the photographic materials of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 2 minutes, and preferably the temperature is from 25° to 40° C. and the time is from 30 seconds to 1 minute and 30 seconds.

Even when employing such a short-time rinsing, an increase of stains may be prevented and good photographic characteristics can be obtained in accordance with the method of the present invention.

Alternatively, the photographic materials of the present invention may also be processed directly with a stabilizing solution in place of being rinsed with water. For the stabilization, any known method, for example as described in JP-A-57-8543, JP-A-58-14834, JP-A-59-184343, JP-A-60-220345, JP A 60-238832, JP-A-60-239784, JP-A-60-239749, JP-A-61-4054 and JP-A-61-118749, can be employed. In particular, a stabilizing bath containing 1-hydroxyethylidene-1,1-diphosphonic acid, 5-chloro-2-methyl-4-isothiazolin-3-one, a bismuth compound or an ammonium compound is preferably used.

In addition, the material can also be stabilized, following the rinsing step. As one example thereof, there may be mentioned a stabilizing bath containing formalin and a surfactant, which is used as a final bath for picture-taking color photographic materials.

The processing time as referred to herein is defined to be the time from the photographic material to be processed being first brought into contact with the color developer to the time when the same material is finally taken out form the final bath (generally, rinsing or stabilizing bath). In a rapid processing procedure where the processing time is 3 minutes and 30 seconds or less, preferably 3 minutes or less, the effect of the present invention is especially remarkable.

Next, the silver halide color photographic materials to be processed by the method of the present invention will be explained in detail hereunder.

The silver halide emulsion of the present invention substantially comprises silver chloride. The wording "substantially comprises silver chloride" as referred to herein means that the silver chloride content in the total silver halide is 80 mol% or more, preferably 95 mol% or more, more preferably 98 mol% or more. The silver chloride content in the silver halide emulsion is preferably as hi9h as possible, from the view point of the rapid processability of the emulsion. The high silver chloride emulsion may contain a small amount of silver bromide or silver iodide. Incorporation of such silver halide would often be favorable for the purpose of increasing the light absorption in view of the light-sensitivity of the emulsion, strengthening the adsorbability of spectral sensitizing dyes in the emulsion or weakening the desensitization by spectral sensitizing dyes therein.

The silver halide grains contained in the photographic emulsion layer of the photographic material to be processed by the method of the present invention may have different phases in the inside and the outer surface of the grain, or may have a multi-layer structure with a junction structure, or may have a uniform phase throughout the whole grain. The emulsion may comprise various grains of different structures in mixture.

The silver halide grains in the photographic emulsion may be those having a regular crystalline form such as a cubic, octahedral or tetradecahedral crystalline form, or those having an irregular crystalline form such as a spherical or tabular crystalline form, or those having a crystal defect such as a twin plane, or may also be those having a composite form of such various crystal forms.

Regarding the grain size of the silver halide grains in the emulsion, the grains may be fine grains having a grain size of about 0.2 micron or less or may be large grains having a grain size (diameter of projected area) of up to about 10 microns. The emulsion may either be a polydispersed emulsion or a monodispersed emulsion.

The monodispersed emulsion used in the present invention is an emulsion having a grain size distribution such that a coefficient of variation with respect to grain diameter of silver halide grains, $S/\bar{r}$, is not more than about 0.15, wherein S represents a standard deviation with respect to grain size, and $\bar{r}$ represents an average grain diameter.

The average grain diameter ($\bar{r}$) and the standard deviation (S) are defined by the following formulae, respectively:

$$\bar{r} = \frac{\Sigma n_i \cdot r_i}{\Sigma n_i}$$

$$S = \sqrt{\frac{\Sigma(\bar{r} - r_i)^2 \cdot n_i}{\Sigma n_i}}$$

wherein $r_i$ represents a grain diameter of each emulsion grain, and $n_i$ represents a number of the grains having the grain diameter of $r_i$.

The term "grain diameter of each emulsion grain" as used herein means a projected area-corresponding diameter which correponds to a diameter corresponding to an area projected at microphotographing the silver halide emulsion by using a method which is well known in this art (normally using an electron microscope), as described in T. H. James et al., *The Theory of the photographic Process,* 3rd Ed., pp. 36–43, Macmillan Publishing Co., (1966). The projected area-corresponding diameter of the silver halide grain is defined as a diameter of a circle equal to the projected area of the silver halide grain as shown in the above-described literature by T. H. James et al. Therefore, even if the shape of the silver hlaide grain is not spherical form (e.g., cubic, octahedral, tetradecahedral, tabular, potato-like), the average grain diameter ($\bar{r}$) and the standard deviation (S) can be measured.

The silver halide photographic emulsion for use in the present invention can be prepared, for example, in accordance with the method described in *Research Disclosure* (RD), Item 17643 (December, 1978), pages 22 to 23, "I. Emulsion Preparation and Types".

Monodispersed emulsions described in U.S. Pat. Nos. 3,574,638 and 3,655,394 and British Patent 1,413,748 are also preferably used in the present invention.

In addition, tabular grains having an aspect ratio of about 5 or more may also be employed in the present invention. Such tubular grains can easily be prepared in accordance with the methods described in Gutoff, *Photographic Science and Engineering,* Vol. 14, pages 248 to 257 (1970), U.S. Pat. Nos. 4,434,226, 4,414,310, 4,433,048 and 4,439,520 and British Patent 2,112,157.

The crystal structure of the silver halide grains in the emulsion of the present invention may be uniform, or may comprise different halogen compositions in the inside and the outside, or may have a layered structure. Further, silver halides of different compositions may be combined by epitaxial junction to form one silver halide grain, or a compound other than silver halide, such as silver rhodanide or lead oxide, may be combined with silver halide to form on the silver halide grain.

In addition, a mixture of grains of different crystalline structures may also be used in the present invention.

The silver halide emulsion for use in the present invention is generally physically-ripened, chemically-ripened or spectrally-sensitized. Additives which are used in these steps are described in *Research Disclosure,* Items 17643 and 18716, and the relevant parts are shown in the Table below.

Other known photographic additives which are usable in the present invention are also mentioned in the above two literatures, and the relevant parts are also shown in the following Table.

| Kinds of Additives | RD 17643 | RD 18716 |
|---|---|---|
| 1. Chemical Sensitizer | p. 23 | p. 648, right column |
| 2. Sensitivity-enhancer | | " |
| 3. Spectral Sensitizer<br>Super Color Sensitizer | pp. 23–24 | from p, 648, right column to p. 649, right column |
| 4. Brightening Agent | p. 24 | |
| 5. Anti-foggant<br>Stabilizer | pp. 24–25 | p. 649, right column |
| 6. Light Absorbent<br>Filter Dye<br>UV Absorbent | pp. 25–26 | from p. 649, right column to p. 650, left column |
| 7. Stain Inhibitor | p. 25, right column | p. 650, from left to right column |
| 8. Color Image Stabilizer | p. 25 | |
| 9. Hardening Agent | p. 26 | p. 651, left column |
| 10. Binder | p. 26 | " |
| 11. Plasticizer<br>Lubricant | p. 27 | p. 650, right column |
| 12. Coating Aid<br>Surfactant | pp. 26–27 | " |
| 13. Antistatic Agent | p. 27 | " |

As sensitizing dyes which can be used in the present invention, those of the following formulae (VIa) and (VIb) are preferred, as they are effective for preventing generation of stains and for improving the stability of the photographic characteristics in continuous processing of the high silver chloride color photographic material with the color developer containing a determined amount of chloride ion and a determined amount of bromide ion in accordance with the method of the present invention.

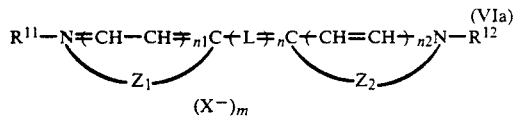

(VIa)

wherein L represents an unsubstituted methine group or a substituted methine group;

$R^{11}$ and $R^{12}$ each represents an unsubstituted alkyl group or a substituted alkyl group;

$Z_1$ and $Z_2$ each represents an atomic group necessary for forming a nitrogen-containing 5-membered or 6-membered heterocyclic nucleus;

$X^-$ represents an anion;

n represents a numerical value of 1, 3 or 5;

$n_1$ and $n_2$ each represents 0 or 1; when n is 5, both $n_1$ and $n_2$ are 0 and when n is 3, either $n_1$ or $n_2$ is 0; m represents 0 or 1, but m is 0 when the compound forms an inner salt;

when n is 5, the plural L groups may be bonded to each other to form a substituted or unsubstituted 5-membered or 6-membered ring.

The cyanine dyes as represented by general formula (VIa) will be explained in detail hereunder.

As the substituents for the substituted methine group of L, there are mentioned a lower alkyl group (e.g., methyl, ethyl) and an aralkyl group (e.g., benzyl, phenethyl).

The alkyl group for $R^{11}$ and $R^{12}$ may be linear or branched or cyclic. Although not limitative, the number of the carbon atoms of the alkyl group is preferably from 1 to 8, especially preferably from 1 to 4. As the substituents for the substituted alkyl group, there are mentioned, for example, a sulfonic acid group, a carboxylic acid group, a hydroxyl group, an alkoxy group, an acyloxy group and an aryl group (e.g., phenyl, substituted phenyl). These substituents may be substituted on the alkyl group singly or in combination of two or more of them. The sulfonic acid group and carboxylic acid group may form a salt with an alkali metal ion or a quaternary ion of an organic amine. The combination of two or more substituents includes the case where the plural substituents are bonded to the alkyl group independently or the case where the plural substituents are bonded to each other and the combined substituents are bonded to the alkyl group.

As examples of the latter case, there are mentioned a sulfoalkoxyalkyl group, a sulfoalkoxyalkoxyalkyl group, a carboxyalkoxyalkyl group and a sulfophenylalkyl group.

As examples of $R^{11}$ and $R^{12}$, there are mentioned methyl, ethyl, n-propyl, n-butyl, vinylmethyl, 2-hydroxyethyl, 4-hydroxybutyl, 2-acetoxyethyl, 3-acetoxypropyl, 2-methoxyethyl, 4-methoxybutyl, 2-carboxyethyl, 3-carboxypropyl, 2-(2-carboxyethoxy)ethyl, 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)-propyl, 2-[2-(3-sulfopropoxy)ethoxy]ethyl and 2-hydroxy-3-(3'-sulfopropoxy)propyl groups.

As specific examples of the nitrogen-containing heterocyclic nuclei to be formed by $Z_1$ or $Z_2$ in formula (VIa), there are mentioned oxazole, thiazole, selenazole, imidazole, pyridine, oxazoline, thiazoline, selenazoline and imidazoline nuclei, as well as condensed nuclei thereof which are condensed with a benzene ring, naphthalene ring or other saturated or unsaturated carbon ring. The nitrogen-containing hetero-rings may have further substituent(s) (for example, an alkyl group, a trifluoromethyl group, an alkoxycarbonyl group, a cyano group, a carboxylic acid group, a carbamoyl group, an alkoxy group, an aryl group, an acyl group, a hydroxyl group, a halogen atom).

As the anion for X in formula (VIa), there are mentioned, for example, $Cl^-$, $Br^-$, $I^-$, $SO_4^{--}$, $NO_3^-$ and $ClO_4^{--}$.

Specific examples of the cyanine dyes of formula (VIa) which are preferred for the yellow layer and cyan layer are mentioned below.

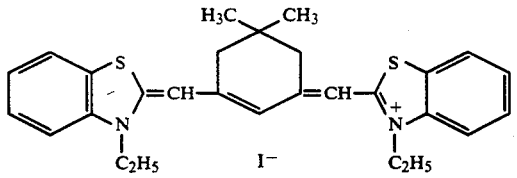

(VIa-1)

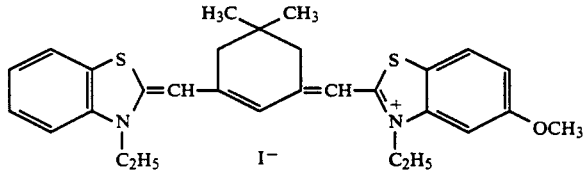

(VIa-2)

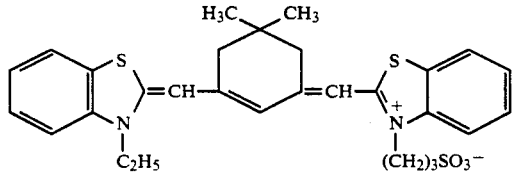

(VIa-3)

-continued
(VIa-4)
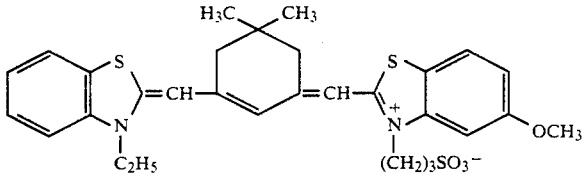
(VIa-5)
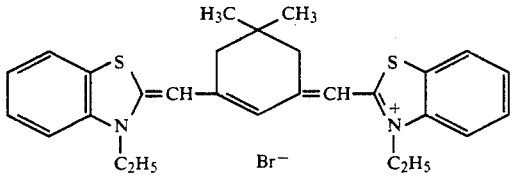
(VIa-6)
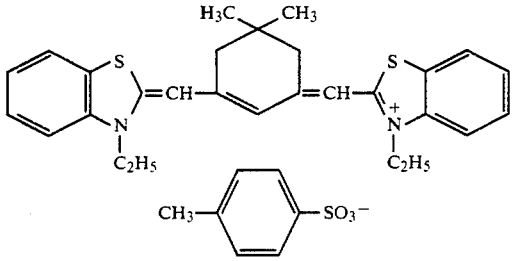
(VIa-7)
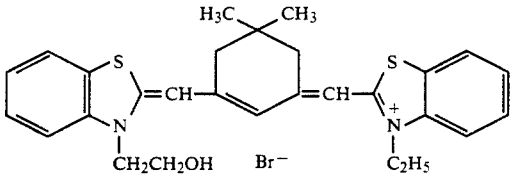
(VIa-8)
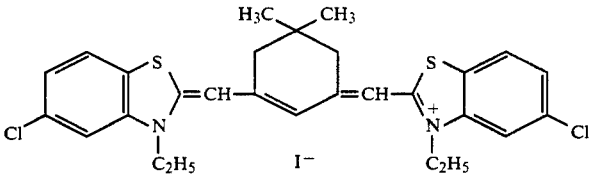
(VIa-9)
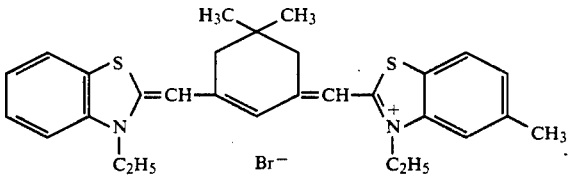
(VIa-10)
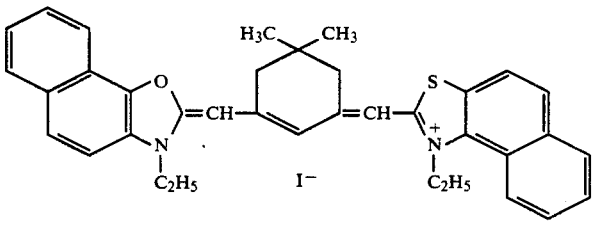
(VIa-11)
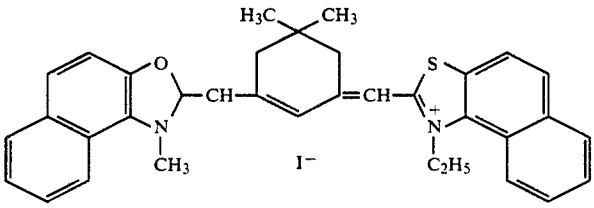

-continued
(VIa-12)
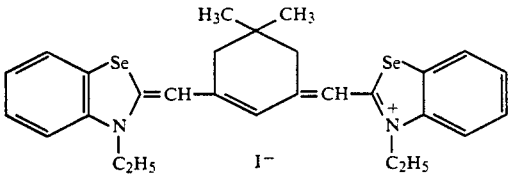
(VIa-13)
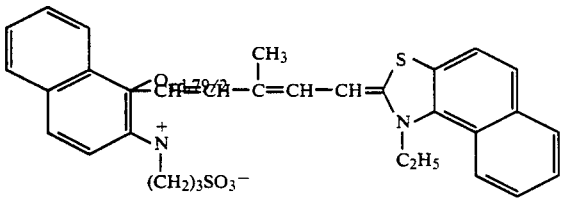
(VIa-14)
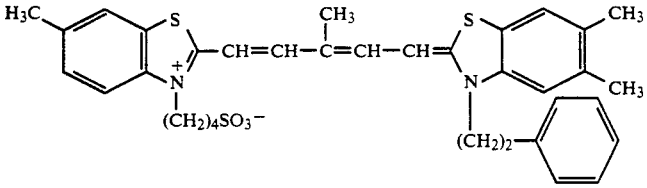
(VIa-15)
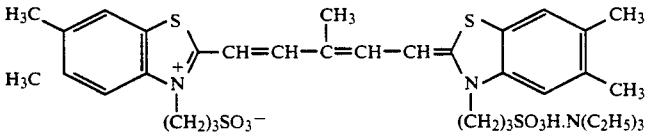
(VIa-16)
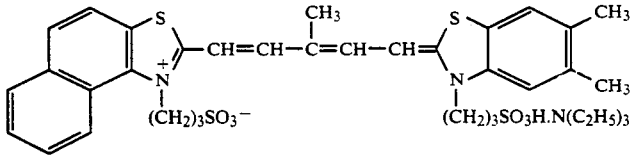
(VIa-17)
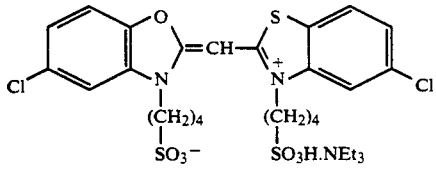
(VIa-18)
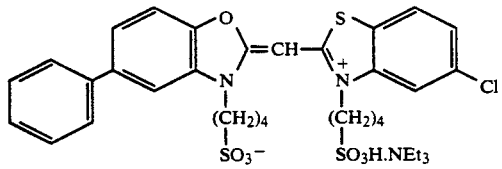
(VIa-19)
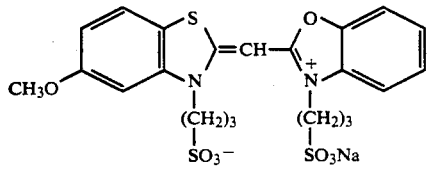
(VIa-20)
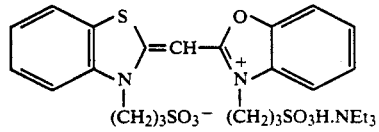

-continued
(VIa-21)
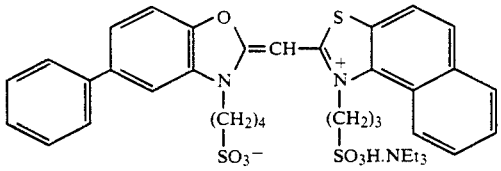
(VIa-22)
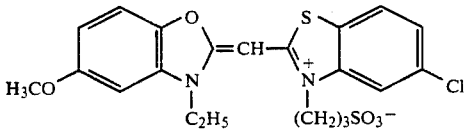
(VIa-23)
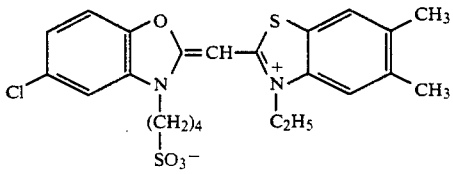
(VIa-24)
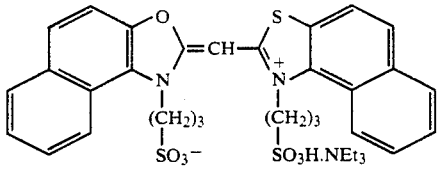
(VIa-25)
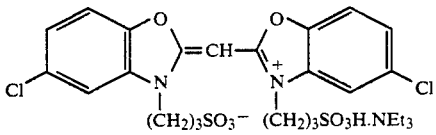
(VIa-26)
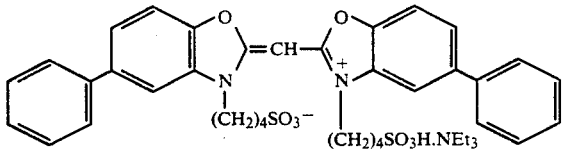
(VIa-27)
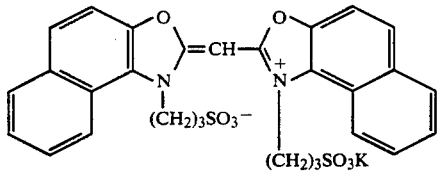
(VIa-28)
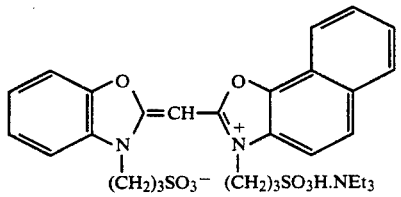
(VIa-29)
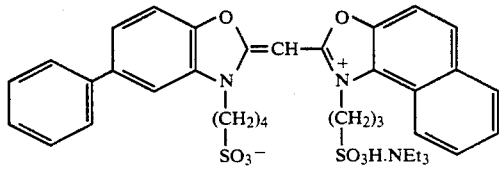

-continued
(VIa-30)
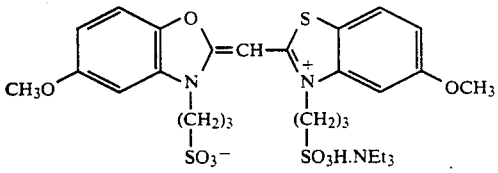
(VIa-31)
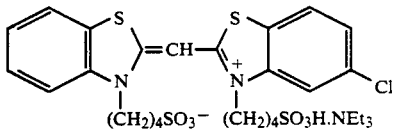
(VIa-32)
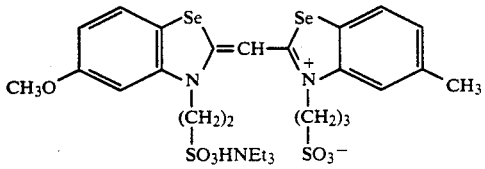
(VIa-33)
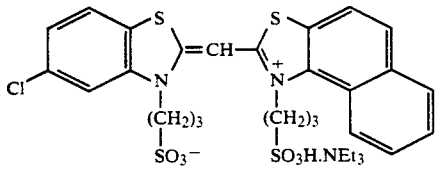
(VIa-34)
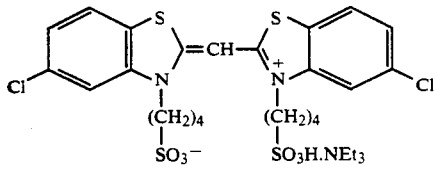
(VIa-35)
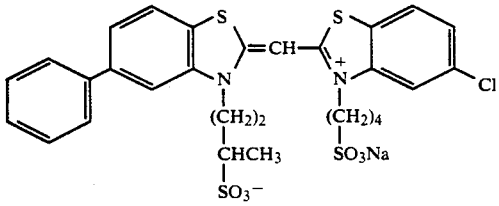
(VIa-36)
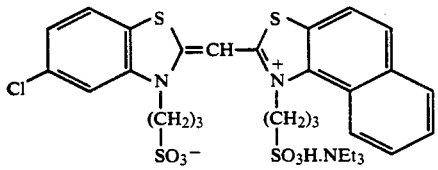
(VIa-37)
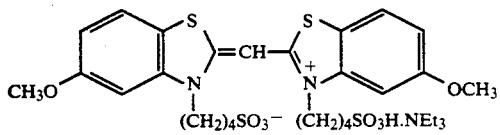
(VIa-38)
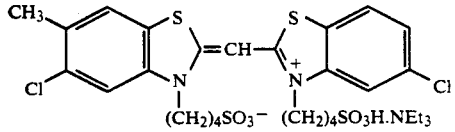

-continued (VIa-39)

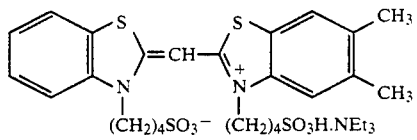

(VIa-40)

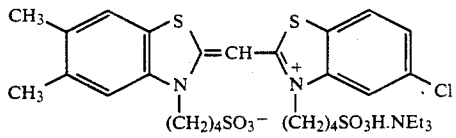

(VIa-41)

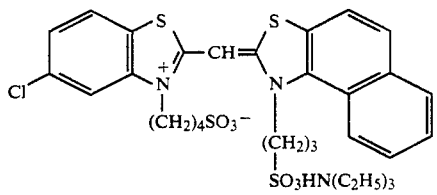

(VIa-42)

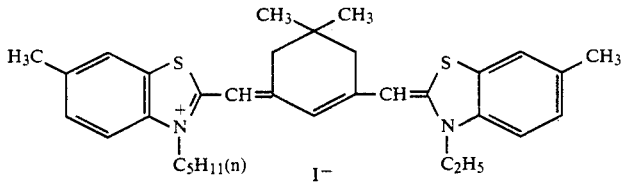

Wherein "Et" represents an ethyl group.

Next, sensitizing dyes preferred for a greensensitive emulsion layer are shown below, which are represented by the following formula (VIb):

(VIb)

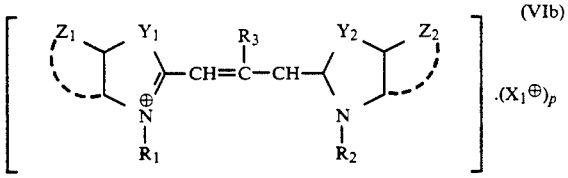

wherein $Z_1$ and $Z_2$ each represents an atomic group necessary for forming a benzene or naphthalene ring as condensed to the hetero-ring in the formula, and the condensed heterocyclic ring to be formed may be substituted by substituent(s);

$R_1$ and $R_2$ each represents an alkyl group, an alkenyl group or an aryl group;

$R_3$ represents a hydrogen atom or an alkyl group having from 1 to 3 carbon atoms;

$X_1^-$ represents an anion;

p represents 0 or 1; and $Y_1$ and $Y_2$ each represents an oxygen atom, a sulfur atom, a selenium atom, a nitrogen atom or a tellurium atom.

Preferred substituents for the condensed heterocyclic nuclei of formula (VIb) include a halogen atom, an aryl group, an alkenyl group, an alkyl group and an alkoxy group. Especially preferred substituents are a halogen atom, a phenyl group and a methoxy group, and the most preferred substituent is a phenyl group.

Preferably, $Z_1$ and $Z_2$, of formula (VIb) both are benzene or thiazole rings as condensed to the oxazole ring. At least one benzene ring is substituted by a phenyl group on its 5-position; or one benzene ring is substituted by a phenyl group on its 5-position and the other benzene ring is substituted by a halogen atom at its 5-position.

$R_1$ and $R_2$ in formula (VIb) each represents an alkyl group, an alkenyl group or an aryl group. Preferably, they each represent an alkyl group substituted by a carboxyl group or a sulfo group. More preferably, they each represent a sulfoalkyl group having from 1 to 4 carbon atoms. Most preferably, they are sulfoethyl groups. $R_3$ in formula (VIb) represents a hydrogen atom or an alkyl group having from 1 to 3 carbon atoms. Preferably, it is a hydrogen atom or an ethyl group.

The sensitizing dyes of formula (VIb) which can be used in the present invention can be combined with any other sensitizing dye to form a so-called supercolor sensitization system. In this case, the respective dyes are dissolved in the same or different solvents and the resulting solutions are blended prior to be added to the emulsion. Alternatively, the respective sensitizing dyes may be added to the emulsion separately. In the latter case of separately adding the dyes to the emulsion, the order of the addition and the interval between the first addition of one dye to the next addition of another dye may freely be determined in accordance with the object.

Specific examples of sensitizing dyes of the formula (VIb) are mentioned below, which, however, are not intended to restrict the scope of the sensitizing dyes employable in the present invention.

(VIb-1)
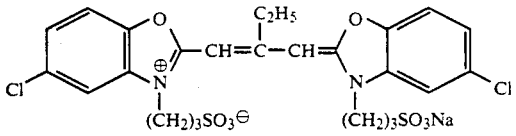
(VIb-2)
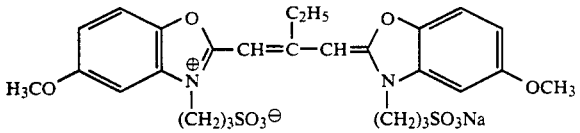
(VIb-3)
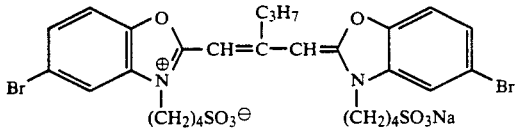
(VIb-4)
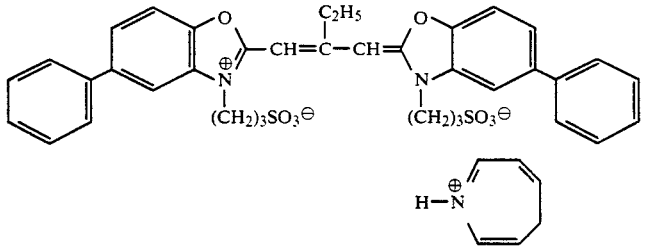
(VIb-5)
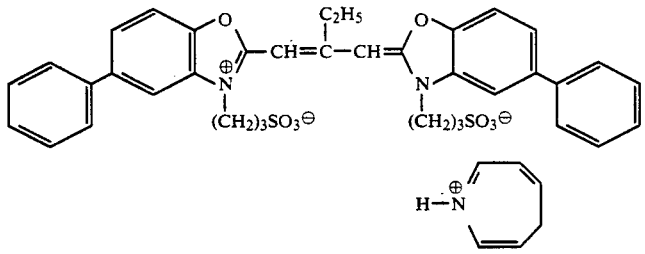
(VIb-6)
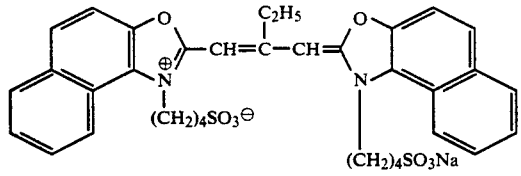
(VIb-7)
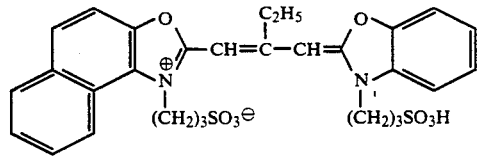
(VIb-8)
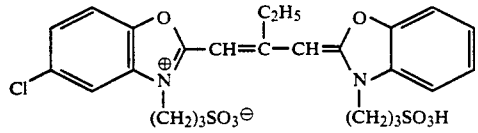

-continued
(VIb-9)
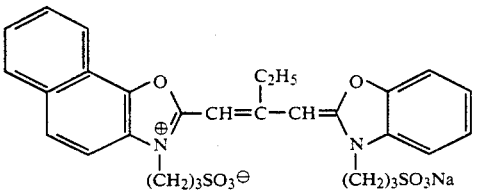
(VIb-10)
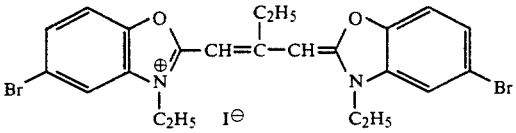
(VIb-11)
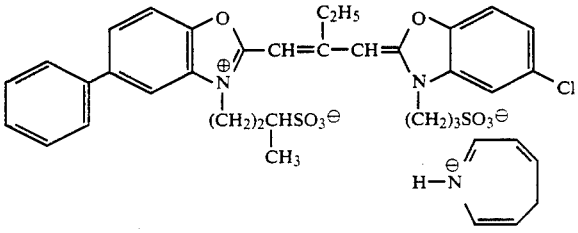
(VIb-12)
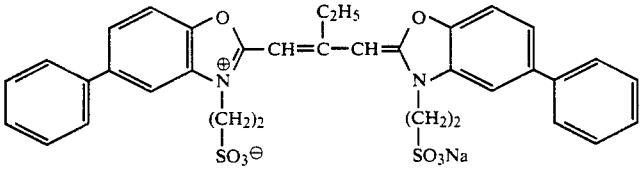
(VIb-13)
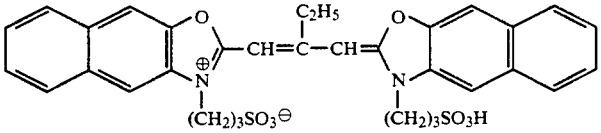
(VIb-14)
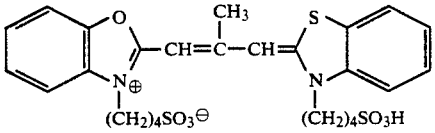
(VIb-15)
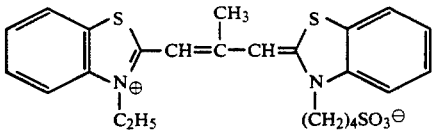
(VIb-16)
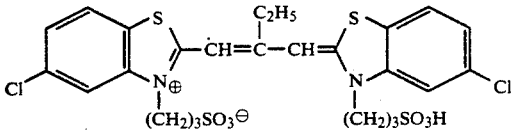
(VIb-17)
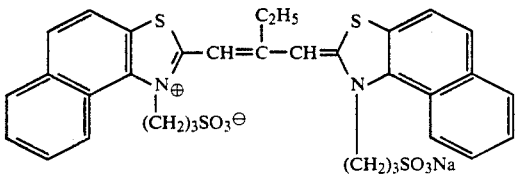

-continued
(VIb-18)
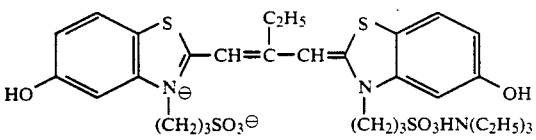
(VIb-19)
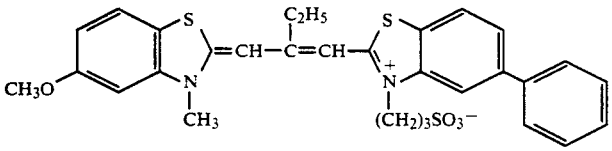
(VIb-20)
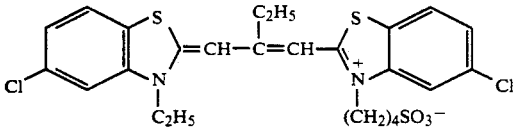
(VIb-21)
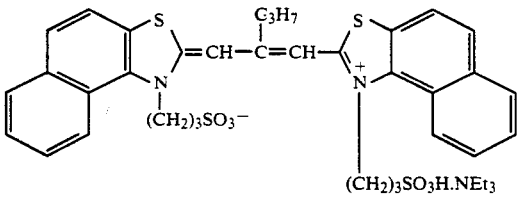
(VIb-22)
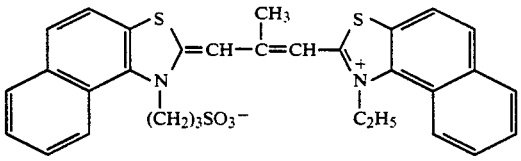
(VIb-23)
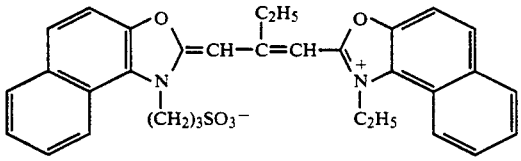
(VIb-24)
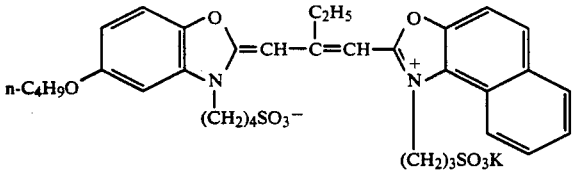
(VIb-25)
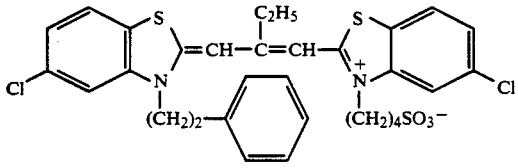
(VIb-26)
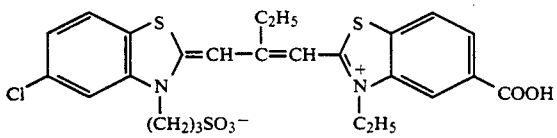

-continued
(VIb-27)
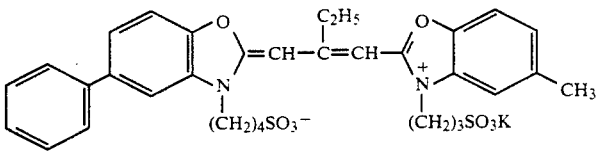
(VIb-28)
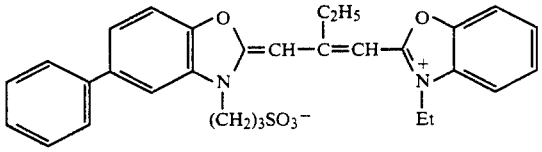
(VIb-29)
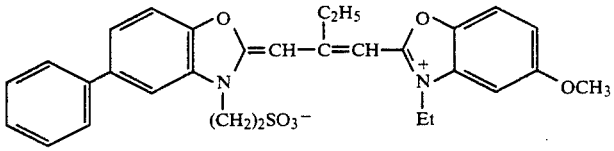
(VIb-30)
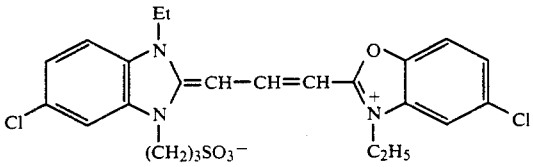
(VIb-31)
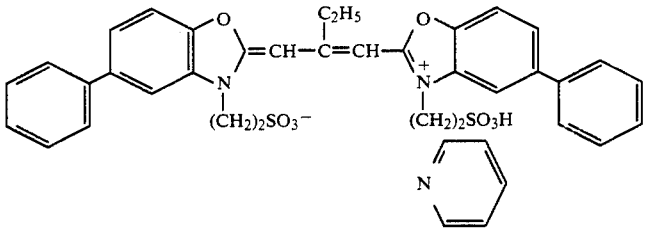
(VIb-32)
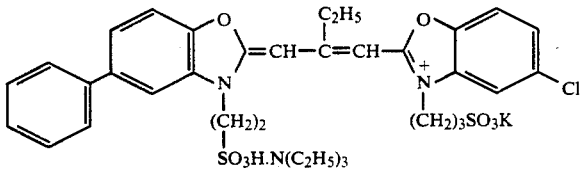
(VIb-33)
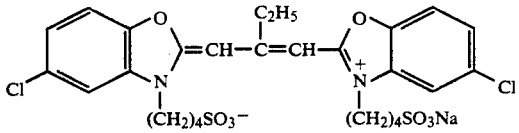
(VIb-34)
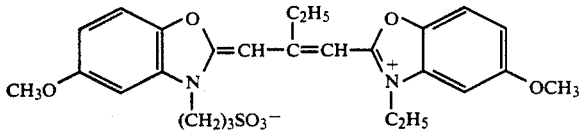
(VIb-35)
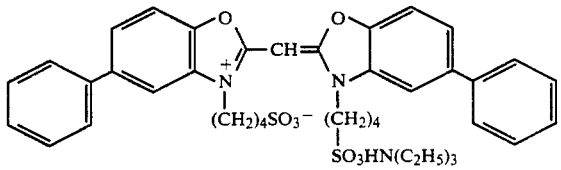

-continued (VIb-36)

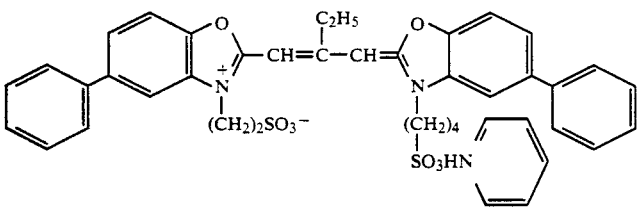

For spectral sensitization of silver halide emulsions, in general, a method is employed where a spectral sensitizing dye is applied to silver halide grains which have completely been formed so that the dye may be adsorbed on the surface of the grains. As opposed to this, U.S. Pat. No. 2,735,766 illustrates a different method where a merocyanine dye is added during formation of precipitates of silver halide grains and it mentions that the amount of dye which does not adsorb on to the grains may be reduced. JP-A-55-26589 illustrates a method of adding a spectral sensitizing dye to the reaction system during addition of an aqueous silver salt solution and an aqueous halide solution whereby the dye is adsorbed on to the silver grains being formed. Accordingly, addition of spectral sensitizing dyes may be effected during formation of silver halide crystalline grains, or after formation thereof, or before the initiation of formation of the grains. Precisely, addition of the spectral sensitizing dye before the initiation of formation of silver halide grains refers to methods in which the spectral sensitizing dyes are added to the reactor prior to initiation of the reaction of forming silver halide crystalline grains. Addition of the dye during formation of the grains refers to methods such as described in the above two patent publications; and addition of the dye after formation of the grains refers to methods in which the dye is added substantially after completion of the grain-forming step and is adsorbed on to the already formed grains.

The silver halide emulsion for use in the present invention can be chemically sensitized after formation of the grains, and addition of the spectral sensitizing dye also can be effected after completion of the formation of the grains. In general, the addition of the spectral sensitizing dye may be effected before initiation of the chemical sensitization, or during the course of the chemical sensitization, or after the chemical sensitization, or immediately before coating the emulsion on a support.

In accordance with the present invention, addition of the spectral sensitizing dye is preferably conducted during the course of at least one step after the substantial completion of formation of the silver halide grains so that the spectral sensitizing dye is adsorbed to the grains. Addition of the spectral sensitizing dyes may be effected during the course of two or more steps or the dyes may be added separately in two or more steps. Where the dye is added in one step, it may be added intensively in a short period of time or it may be gradually and continuously added over a long period of time. Two or more of such addition methods may be combined in practical performance.

The spectral sensitizing dye may be added as it is in a crystalline or powdery form, but it is preferably added in the form or a solution or dispersion prepared by an appropriate dissolving or dispersing method. Where the dye is formed into a solution, it may be dissolved in a water-soluble solvent such as an alcohol having from 1 to 3 carbon atoms, acetone, pyridine or methyl cellosolve or a mixed solvent thereof. Surfactants may be employed for forming a micelle dispersion containing the dye. Other types of dispersions may also be prepared.

The amount of the spectral sensitizing dye to be added to the silver halide emulsion for use in the present invention depends upon the object of spectral sensitization and the content of the emulsion, in general, is from $1\times10^{-6}$ mol to $1\times10^{-2}$ mol, more preferably from $1\times10^{-5}$ mol to $5\times10^{-3}$ mol, per mol of the silver halide.

The emulsion for use in the present invention is generally physically ripened, chemically ripened and spectrally sensitized. Additives to be used in these steps are described in *Research Disclosure,* Vol. 176, Item 17643 (December, 1979) and ibid., Vol. 187, Item 18716 (November, 1979), and the relevant parts are shown in the Table set forth above.

In accordance with the present invention, various color couplers can be employed, and examples thereof are described in patent publications as referred to in *Research Disclosure,* Vol. 176, Item 17643, VII-C to G.

As yellow couplers for use in the present invention, for example, those described in U.S. Pat. Nos. 3,933,501, 4,022,620, 4,326,024 and 4,401,752 JP-A-58-10739 and British Patents 1,425,020 and 1,476,760 are preferred.

As magenta couplers, 5-pyrazolone type and pyrazoloazole type compounds are preferred and, for example, those described in U.S. Pat. Nos. 4,310,619 and 4,351,897, European Patent 73,636, U.S. Pat. Nos. 3,061,432 and 3,725,067, *Research Disclosure,* Item 24220 (June, 1984), JP-A-60-33552, *Research Disclosure,* Item 24230 (June, 1984), JP-A-60-43659 and U.S. Pat. Nos. 4,500,630 and 4,540,654 are especially preferred.

As cyan couplers, phenol type and naphthol type couplers are mentioned and, for example, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent 121,365A, U.S. Pat. Nos. 3,446,622, 4,333,999, 4,451,559 and 4,427,767 and European Patent 161,626A are preferred.

Colored couplers for correcting the unnecessary absorption of colored dyes can also be employed in the present invention, and those described in *Research Disclosure,* Vol. 176, Item 17643, VII-G, U.S. Pat. No. 4,163,670, JP-B-57-39413, U.S. Pat. Nos. 4,004,929 and 4,138,258 and British Patent 1,146,368 are preferred.

Couplers giving a colored dye with pertinent diffusibility can also be employed in the present invention, and those described in U.S. Pat. No. 4,366,237, British Patent 2,125,570, European Patent 96,570 and West German Patent Application (OLS) No. 3,234,533 are preferred.

Specific examples of polymerized dye-forming couplers which can be employed in the present invention are described in U.S. Pat. Nos. 3,451,820, 4,080,211 and 4,367,282 and British Patent 2,102,173.

Couplers which release a photographically useful residue during coupling can also be preferably used in the present invention. For instance, DIR couplers which release a development inhibitor which are described in patent publications as referred to in *Research Disclosure,* Vol. 176, Item 17643, VII-F, JP-A-57-151944, JP-A 57-154234 and JP-A-60-184248 and U.S. Pat. No. 4,248,962 are preferred.

As couplers which imagewise release a nucleating agent or development accelerator in development, those described in British Patents 2,097,140 and 2,131,188 and JP-A-59-157638 and JP-A-59-170840 are preferred.

In addition, as other couplers which can be employed in the present invention, there are mentioned the competing couplers described in U.S. Pat. No. 4,130,427; the polyvalent couplers described in U.S. Pat. Nos. 4,283,472, 4,338,393 and 4,310,618; the DIR redox compound-releasing couplers described in JP-A-60-185950; and the couplers which release a dye which recolor after being released, as described in European Patent 173,302A.

The above-mentioned couplers can be introduced into the photographic materials of the present invention by various known dispersion methods.

For instance, an oil-in-water dispersion method may be employed for the purpose, and examples of high boiling point solvents usable in such a method are described in U.S. Pat. No. 2,322,027.

A latex dispersion method may also be employed, and the step and effect thereof as well as latexes to be used for impregnation in the method are described in U.S. Pat. No. 4,199,363, and West German Patent Application (OLS) Nos. 2,541,274 and 2,541,230.

In accordance with the present invention, the following compounds are preferably employed together with the above-mentioned couplers. In particular, such compounds are especially preferably employed in combination with pyrazoloazole couplers.

Specifically, compounds (F) which may chemically bond with the aromatic amine developing agent which remains after color development to give a chemically inactive and substantially colorless compound and/or compounds (G) which may chemically bond with the oxidation product of the aromatic amine developing agent which remains after color development to give a chemically inactive and substantially colorless compound are preferably employed simultaneously or singly. Employment of such compounds is preferred, for example, for preventing stains which are caused by formation of colored dyes by reaction between the developing agent or the oxidation product thereof which remains in the film and the coupler which also remains therein during storage of the processed material and also for preventing other harmful side-reactions.

As the compounds (F), preferred are compounds which react with p-anisidine with a secondary reaction speed constant k2 (in trioctyl phosphate at 80° C.) of from 1.0 liter/mol.sec to $1\times10^{-5}$ liter/mol.sec. The secondary reaction speed constant can be measured by the method described in JP-A-63-158545.

If the value k2 is larger than the above range, the (F) compounds themselves would be unstable and would often react with gelatin and water to decompose. On the other hand, if it is smaller than the above range, the reaction speed of the (F) compound with the remaining aromatic amine developing agent would be low and, as a result, the object of the present invention to prevent the harmful side effects of the remaining aromatic amine developing agent could not be attained.

More preferred examples of such compounds (F) are those represented by the following formula (FI) or (FII).

$$R_1\text{-}(A)_n\text{-}X \qquad \text{(FI)}$$

$$R_2-\underset{\underset{B}{|}}{C}=Y \qquad \text{(FII)}$$

In these formulae (FI) and (FII), $R_1$ and $R_2$ each represents an aliphatic group, an aromatic group or a heterocyclic group; n represents 1 or 0; A represents a group capable of reacting with an aromatic amine developing agent to form a chemical bond; X represents a group capable of reacting with an aromatic amine developing agent to be released; B represents a hydrogen atom, an aliphatic group, an aromatic group, a heterocyclic group, an acyl group or a sulfonyl group; and Y represents a group which accelerates addition of an aromatic amine developing agent to the compound of formula (FII). $R_1$ and X; and Y and $R_2$ or B may be bonded to each other to form a cyclic structure.

Typical methods of reacting the compound (F) and the remaining aromatic amine developing agent by chemical bond are a substitution reaction or an addition reaction.

Specific examples of the compounds of formulae (FI) and (FII) are described in JP-A-63-158545, JP-A-62-283338, JP-A-64-2042 and JP-A-64 86139 and are preferably employed in the present invention.

On the other hand, as a compound (G) which chemically bonds with the oxidation product of the aromatic amine developing agent which remains after color developement to give a chemically inert and substantially colorless compound, more preferred are those represented by the following formula (GI):

$$R\text{-}Z \qquad \text{(GI)}$$

wherein R represents an aliphatic group, an aromatic group or a heterocyclic group; and Z represents a nucleophilic group or a group which releases a nucleophilic group after being decomposed in the photographic material.

In the compounds of formula (GI), Z is preferably a group having a nucleophilic $nCH_3I$ value (R. G. Pearson, et al, *J. Am. Chem. Soc.,* 90, 319 (1968)) of 5 or more or a group to be derived therefrom.

Specific examples of the compounds of the formula (GI) are described in European Patent 255,722, JP-A-62-143048, JP-A-62-229145, JP-A-64-2042, JP-A-64-86139 and JP-A-64-57259 and Japanese Patent Application No. 63-136724 are preferably used in the present invention.

The details of the combinations of the abovementioned compounds (G) and compounds (F) are described in JP-A-64-86139.

Suitable supports which are employable in the present invention are described in the above-mentioned *Research Disclosure,* Item 17643, page 28, and ibid, Item 18716, from page 647, right column to page 648, left column.

The method of the present invention can be applied to color photographic materials, for example, color negative films, color reversal films (coupler-in-emulsion type, or couper in-developer type), color papers, color positive films, color reversal papers, color diffusion transfer process films and direct positive color photographic materials. In particular, it is preferably applied to color negative films, color reversal films and color reversal papers.

The present invention will be explained in more detail with reference to the following examples, which, however, are not intended to restrict the scope of the present invention.

EXAMPLE 1

Plural layers mentioned below were coated on a paper support both surfaces of which were coated with polyethylene, to prepare a multi-layer color photographic paper sample. Coating compositions were prepared as mentioned below.

Preparation of First Layer-Coating Composition 27.2 cc of ethyl acetate and 8.2 g of Solvent (Solv-3) were added to 19.1 g of Yellow Coupler (ExY), 4.4 g of Color Image Stabilizer (Cpd-1) and 0.7 g of Color Image Stabilizer (Cpd-7) and dissolved, and the resulting solution was dispersed by emulsification in 185 cc of a 10 % aqueous gelatin solution containing 8 cc of 10 % sodium dodecylbenzenesulfonate. On the other hand, the following two blue-sensitive sensitizing dyes were added to a silver chlorobromide emulsion (cubic grains having a mean grain size of 0.85 μm and a grain size distribution fluctuation coefficient of 0.07 and containing 1.0 mol% of silver bromide locally on a part of the grain surface), each in an amount of $2.0\times10^{-4}$ mol, and then the resulting emulsion was sulfur-sensitized. The previously prepared emulsified dispersion and the sulfur-sensitized emulsion were blended to prepare a first layer-coating composition comprising the components mentioned below. The other coating compositions for the second layer to the seventh layer were also prepared in a similar manner. As the gelatin hardening agent for each layer, there was used 1-hydroxy-3,5-dichloro-s-triazine sodium salt.

The following spectral sensitizing dyes were used for the respective layers.

Blue-sensitive Emulsion Layer:

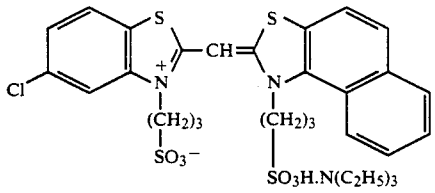

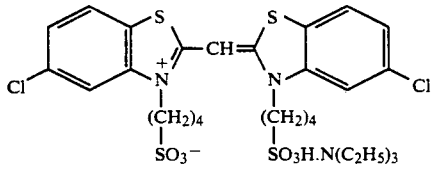

(The above two were incorporated each in an amount of $2.0\times10^{-4}$ mol per mol of silver halide in the layer).

Green-sensitive Emulsion Layer:

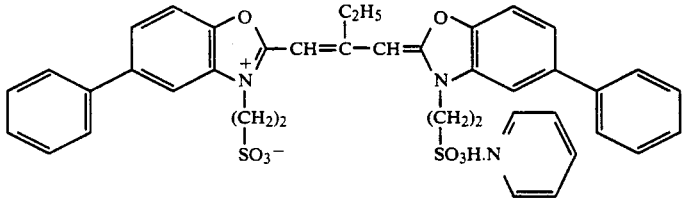

($4.0\times10^{-4}$ mol per mol of silver halide in the layer) and

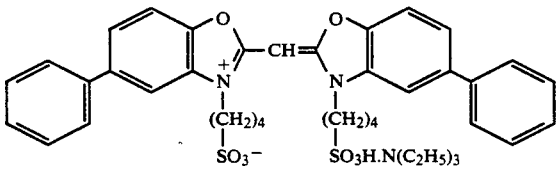

($7.0\times10^{-5}$ mol per mol of silver halide in the layer)

Red-sensitive Emulsion Layer

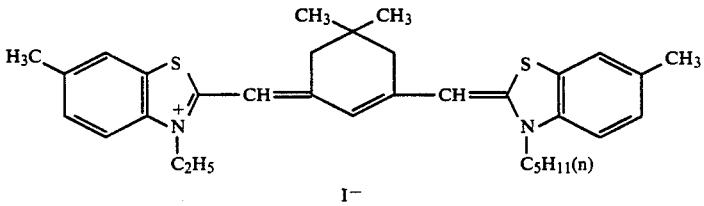

($0.9\times10^{-4}$ mol per mol of silver halide in the layer)

To the red-sensitive emulsion layer was added the following compound in an amount of $2.6\times10^{-3}$ mol per mol of silver halide.

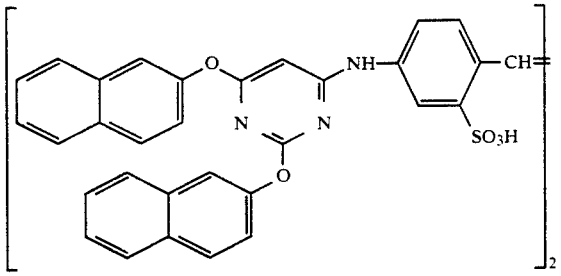

1-(5-Methylureidophenyl)-5-mercaptotetrazole was added to the blue-sensitive emulsion layer, green-sensitive emulsion layer and red-sensitive emulsion layer in an amount of $8.5\times10^{-5}$ mol, $7.7\times10^{-4}$ mol and $2.5\times10^{-4}$ mol, respectively.

The following dyes were added to the emulsion layers for the purpose of anti-irradiation, each in an amount of 4 mg/m$^2$.

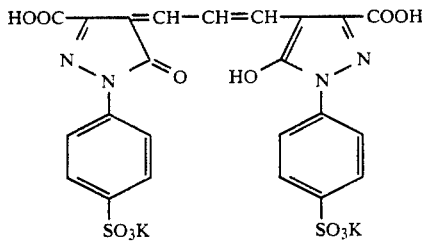

(I-4)

and

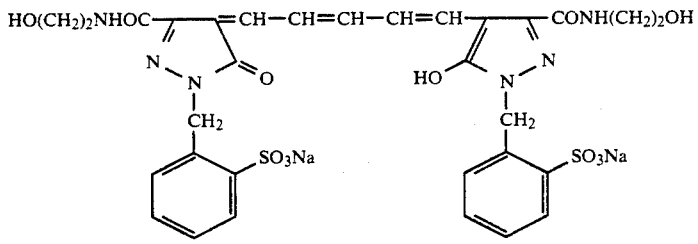

(I-36)

The respective layers comprised the compositions mentioned below. The amount coated is represented by the unit of g/m$^2$. The amount of the silver halide emulsion coated indicates the amount of silver therein.

| | Coated Amount |
|---|---|
| Support: | |
| Polyethylene-laminated Paper (containing a white pigment ($TiO_2$) and a blueish dye (ultramarine) in the polyethylene on the side of the first layer) | |
| First Layer: (Blue-sensitive Emulsion Layer) | |
| Above-mentioned Silver Chlorobromide Emulsion | 0.30 |
| Gelatin | 1.86 |
| Yellow Coupler (ExY) | 0.82 |
| Color Image Stabilizer (Cpd-1) | 0.19 |
| Color Image Stabilizer (Cpd-7) | 0.03 |
| Solvent (Solv-3) | 0.35 |
| Second Layer: (Color Mixing Preventing Layer) | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer: (Green-sensitive Emulsion Layer) | |
| Silver Chlorobromide Emulsion (cubic grains having a grain size of 0.40 μm and a variation coefficient of 0.09 and containing 1 mol % of silver bromide locally on a part of the grain surface) | 0.25 |
| Gelatin | 1.24 |
| Magenta Coupler (ExM) | 0.29 |
| Color Image Stabilizer (Cpd-3) | 0.09 |
| Color Image Stabilizer (Cpd-4) | 0.06 |
| Solvent (Solv-2) | 0.32 |
| Solvent (Solv-7) | 0.16 |
| Fourth Layer: (Ultraviolet Absorbing Layer) | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer: (Red-sensitive Emulsion Layer) | |
| Silver Chlorobromide Emulsion (cubic grains having a grain size of 0.36 μm and a variation coefficient of 0.11 and containing 1.6 mol % of silver bromide locally on a part of the grain surface) | 0.21 |
| Gelatin | 1.34 |
| Cyan Coupler (ExC) | 0.34 |
| Color Image Stabilizer (Cpd-6) | 0.17 |
| Color Image Stabilizer (Cpd-7) | 0.34 |
| Color Image Stabilizer (Cpd-9) | 0.04 |
| Solvent (Solv-6) | 0.37 |
| Sixth Layer: (Ultraviolet Absorbing Layer) | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |
| Seventh Layer: (Protective Layer) | |
| Gelatin | 1.33 |
| Acryl modified Copolymer of Polyvinyl Alcohol (modification degree 17%) | 0.17 |
| Liquid Paraffin | 0.03 |

Compounds used above were as follows:

Yellow Coupler (ExY):

-continued
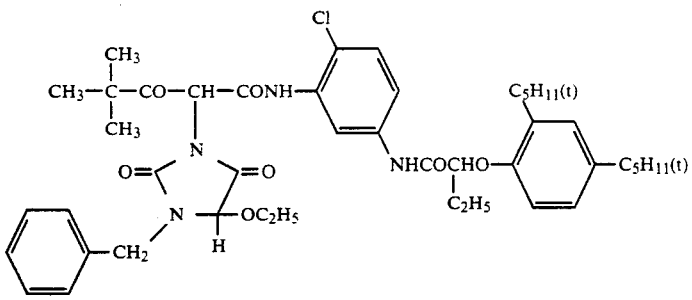
Magenta Coupler (ExM):
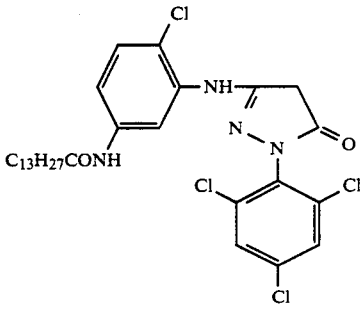
Cyan Coupler (ExC):
1/3/6 mixture (by weight) of the following compounds:
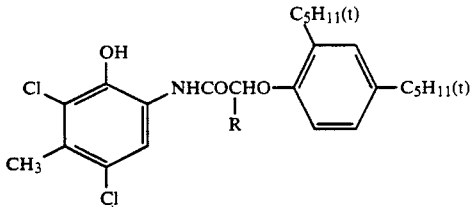
R = H, $C_2H_5$, $C_4H_9$.
Color Image Stabilizer (Cpd-1):
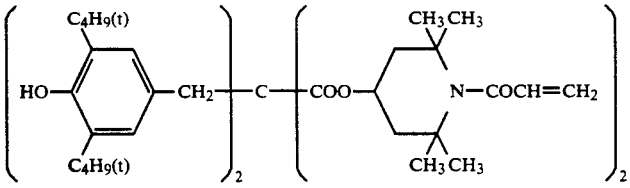
Color Image Stabilizer (Cpd-3):
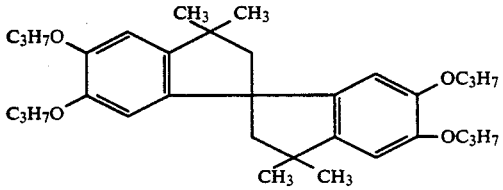
Color Image Stabilizer (Cpd-4):
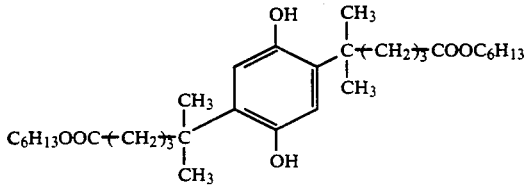
Color Mixing Preventing Agent (Cpd-5):

-continued
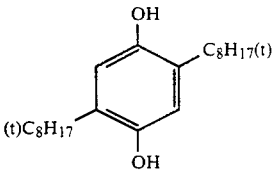
Color Image Stabilizer (Cpd-6):
2/4/4 mixture (by weight) of the following compounds:
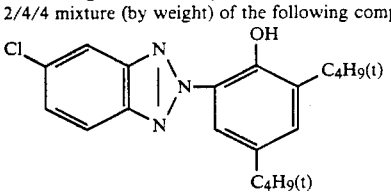
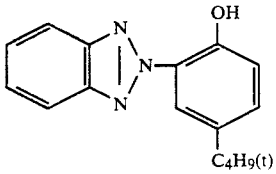
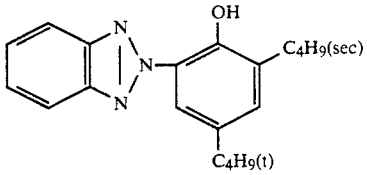
Color Image Stabilizer (Cpd-7):
$$\left(CH_2-\underset{\underset{CONHC_4H_9(t)}{|}}{CH}\right)_n$$
Average molecular weight: 60,000
Color Image Stabilizer (Cpd-9):
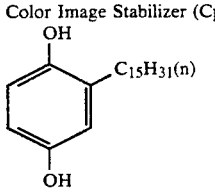
Ultraviolet Absorbent (UV-1):
4/2/4 mixture (by weight) of the following compounds:
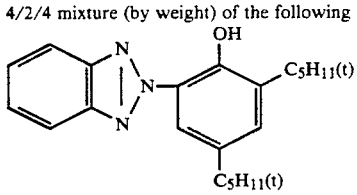
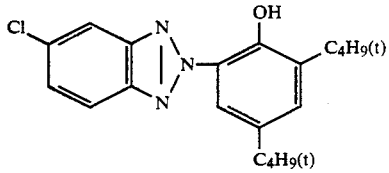
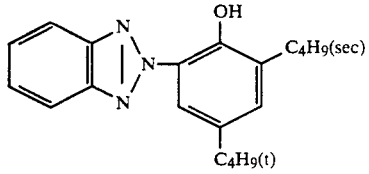

-continued

Solvent (Solv-1):

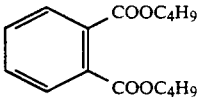

Solvent (Solv-2):
3/7 mixture (by volume) of the following compounds:

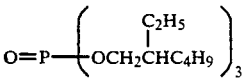

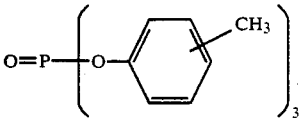

Solvent (Solv-3):
$O{=}P{\leftarrow}O{-}C_9H_{19}(iso))_3$

Solvent (Solv-4):

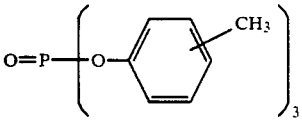

Solvent (Solv-5):

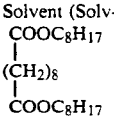

Solvent (Solv-6):

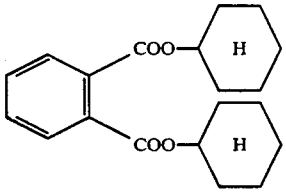

Solvent (Solv-7):

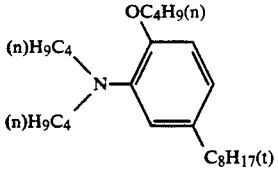

The sample thus prepared was called sample (1-A). Next, Samples (1-B) to (1-E) were prepared in the same manner, except that the anti-irradiation dyes (I-4) and (I-36) were replaced by the following dyes.

| Sample Code | Anti-irradiation Dye Used | Amount Added ($mg/m^2$) |
|---|---|---|
| (I-A) | (I-4) | 4 |
| | (I-36) | 4 |
| (I-B) | (I-1) | 4 |
| | (I-7) | 4 |
| (I-C) | (I-4) | 4 |
| | (I-8) | 4 |

-continued

| Sample Code | Anti-irradiation Dye Used | Amount Added ($mg/m^2$) |
|---|---|---|
| (I-D) | 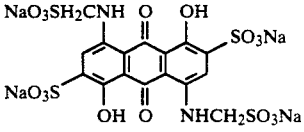 | 8 |

-continued

| Sample Code | Anti-irradiation Dye Used | Amount Added ($mg/m^2$) |
|---|---|---|
| (I-E) | 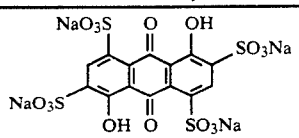 | 8 |

In order to examine the photographic characteristics of the thus prepared Samples (1-A) to (1-E), the following experiment was carried out.

First, the samples were sensitometrically wedgewise exposed by the use of a photo sensitometer (FWH Type, manufactured by Fuji Photo Film Co. Ltd.; color temperature of the light source 3200° K.), whereupon exposure was effected for an exposing time of 1/10 second with an exposing amount of 250 CMS.

The thus exposed samples were then processed by the use of an automatic developing machine in accordance with the steps mentioned below, using the processing solutions also mentioned below. The composition of the color developer was varied as indicated in Table 1 below.

| Processing Steps | Temperature | Time |
|---|---|---|
| Color Development | 38° C. | 45 sec |
| Bleach-fixation | 30 to 36° C. | 30 sec |
| Rinsing (1) | 30 to 37° C. | 20 sec |
| Rinsing (2) | 30 to 37° C. | 20 sec |
| Rinsing (3) | 30 to 37° C. | 20 sec |
| Drying | 70 to 80° C. | 60 sec |

The rinsing was effected by a three-tank countercurrent system from the rinsing tank (3) to the rinsing tank (1).

The processing solutions used in the above steps were as follows:

| Color Developer: | |
|---|---|
| Water | 800 ml |
| Ethylenediamine-N,N,N,N-tetramethylene-phosphonic Acid | 3.0 g |

-continued

| | |
|---|---|
| Preservative (III-19) | 5.0 g |
| Sodium Chloride | See Table 1 |
| Potassium Bromide | See Table 1 |
| Potassium Carbonate | 25 g |
| N-ethyl-N-(β-methanesulfonamidoethyl)-3-methyl-4-aminoaniline Sulfate | 5.0 g |
| Triethanolamine | 10.0 g |
| Brightening Agent (WHITEX 4, manufactured by Sumitomo Chemical Co.) | 2.0 g |
| Water to make | 1000 ml |
| pH (25° C.) | 10.05 |
| Bleach-fixing Solution: | |
| Water | 400 ml |
| Ammonium Thiosulfate (70 wt. %) | 100 ml |
| Sodium Sulfite | 17 g |
| Ammonium Ethylenediaminetetraacetato/iron(III) | 55 g |
| Disodium Ethylenediaminetetraacetate | 5 g |
| Glacial Acetic Acid | 9 g |
| Water to make | 1000 ml |
| pH (25° C.) | 5.40 |

Rinsing Solution

Ion-exchanged Water (Calcium content and magnesium content each was 3 ppm or less.)

After being processed as mentioned above, the minimum density and maximum density of cyan (R) ($D_R$min, $D_R$max) were measured With a Macbeth densitometer in each sample. In addition, the amount of the residual silver in the maximum density was measured with an fluorescent X-ray in each sample. The results are shown in Table 1 below.

TABLE 1

| | Process No. | 1 | 2 | 3 | 4 | 5 | 6 | 7 | 8 | 9 |
|---|---|---|---|---|---|---|---|---|---|---|
| Developer | NaCl (mol/l) | — | $3 \times 10^{-2}$ | $3.5 \times 10^{-2}$ | $6 \times 10^{-2}$ | $1 \times 10^{-1}$ | $1.5 \times 10^{-1}$ | $2 \times 10^{-1}$ | $6 \times 10^{-2}$ | — |
| | KBr (mol/l) | — | $2 \times 10^{-5}$ | $3.5 \times 10^{-5}$ | $2.5 \times 10^{-4}$ | $5 \times 10^{-4}$ | $1.0 \times 10^{-3}$ | $1.5 \times 10^{-3}$ | — | $2.5 \times 10^{-4}$ |
| Sample (I-A) | $D_R$min | 0.16 | 0.14 | 0.11 | 0.,10 | 0.10 | 0.10 | 0.10 | 0.13 | 0.13 |
| | $D_R$max | 2.35 | 2.35 | 2.35 | 2.35 | 2.35 | 2.33 | 2.01 | 2.15 | 2.15 |
| | Residual Silver ($\mu g/cm^2$) | 7.9 | 5.8 | 2.1 | 1.8 | 1.8 | 1.8 | 3.5 | 6.0 | 7.1 |
| (I-B) | $D_R$min | 0.16 | 0.13 | 0.11 | 0.10 | 0.10 | 0.10 | 0.10 | 0.13 | 0.13 |
| | $D_R$max | 2.35 | 2.35 | 2.35 | 2.35 | 2.35 | 2.32 | 1.98 | 2.14 | 2.15 |
| | Residual Silver ($\mu g/cm^2$) | 8.0 | 6.1 | 2.2 | 1.9 | 1.8 | 1.8 | 4.5 | 6.3 | 6.0 |
| (I-C) | $D_R$min | 0.16 | 0.14 | 0.11 | 0.10 | 0.10 | 0.10 | 0.10 | 0.14 | 0.14 |
| | $D_R$max | 2.34 | 2.34 | 2.34 | 2.34 | 2.34 | 2.33 | 2.05 | 2.13 | 2.15 |
| | Residual Silver ($\mu g/cm^2$) | 7.6 | 5.7 | 1.9 | 1.6 | 1.6 | 1.6 | 5.9 | 5.8 | 5.9 |
| (I-D) | $D_R$min | 0.16 | 0.15 | 0.14 | 0.14 | 0.14 | 0.14 | 0.14 | 0.15 | 0.15 |
| | $D_R$max | 2.29 | 2.30 | 2.30 | 2.30 | 2.15 | 2.10 | 2.05 | 2.15 | 2.13 |
| | Residual Silver ($\mu g/cm^2$) | 5.9 | 6.0 | 6.0 | 6.0 | 6.0 | 5.9 | 5.8 | 5.9 | 5.9 |
| (I-E) | $D_R$min | 0.17 | 0.16 | 0.15 | 0.15 | 0.15 | 0.15 | 0.15 | 0.15 | 0.16 |
| | $D_R$max | 2.30 | 2.31 | 2.31 | 2.30 | 2.17 | 2.09 | 2.00 | 2.16 | 2.17 |
| | Residual Silver ($\mu g/cm^2$) | 6.3 | 6.2 | 6.1 | 6.1 | 6.0 | 6.0 | 6.0 | 6.2 | 6.2 |

Where Samples (1 A), (1-B) and (1-C) of the present invention were processed in accordance with processes (3), (4), (5) or (6) of the method of the present invention, the stains in the cyan color were small, the maximum density was high, the amount of the residual silver was small, and excellent photographic characteristics were obtained.

Where Samples (1-D) and (1-E) each having an antiirradiation dye falling outside the scope of the present invention were processed by the method of the present invention, the above-mentioned effect could not be obtained.

EXAMPLE 2

Sample (1-A) was processed by process (4) of Example 1, except that Preservative (III-19) was replaced by the same molar amount of other preservatives, namely, (II-1), (II-2), (III-11) or (III-21), respectively, and when so processed the same excellent photographic characteristics were obtained.

EXAMPLE 3

Samples were prepared in the same manner as Sample (1 A), except that anti-irradiation dyes (I-1), (I-3), (I-5), (I-9), (I-12), (I-18), (I-25), (I-30) or (I-37) was incorporated each in an amount of 8 mg/m$^2$ in place of the anti-irradiation dyes in Sample (1-A), and these were processed by one of the processes (3) to (6). As a result, excellent photographic characteristics were obtained.

EXAMPLE 4

Samples (4-A), (4-B), (4-C) and (4-D) were prepared in the same manner as Sample (1-A) in Example 1, except that the silver bromide content was varied as indicated in the following Table. These were then processed in accordance with processes (2), (4) and (7) of Example 1. The results obtained are shown in Table 2 below.

| Sample Code | Blue-sensitive Layer (Br mol %) | Green-sensitive Layer (Br mol %) | Red-sensitive Layer (Br mol %) |
|---|---|---|---|
| (1-A) | 1.0 | 1.0 | 1.6 |
| (4-A) | 5.0 | 5.0 | 5.0 |
| (4-B) | 10.0 | 10.0 | 10.0 |
| (4-C) | 20.0 | 20.0 | 20.0 |
| (4-D) | 30.0 | 30.0 | 30.0 |

TABLE 2

| | Process No. | 2 | 4 | 7 |
|---|---|---|---|---|
| Developer | NaCl (mol/l) | $3 \times 10^{-2}$ | $6 \times 10^{-2}$ | $2 \times 10^{-1}$ |
| | KBr(mol/) | $2 \times 10^{-5}$ | $2.5 \times 10^{-4}$ | $1.5 \times 10^{-3}$ |
| Sample (I-A) | $D_R$min | 0.14 | 0.10 | 0.10 |
| | $D_R$max | 2.35 | 2.35 | 2.01 |
| | Residual Silver (μg/cm$^2$) | 5.8 | 1.8 | 3.5 |
| (4-A) | $D_R$min | 0.15 | 0.10 | 0.10 |
| | $D_R$max | 2.29 | 2.30 | 2.00 |
| | Residual Silver (μg/cm$^2$) | 5.3 | 1.8 | 4.0 |
| (4-B) | $D_R$min | 0.15 | 0.11 | 0.11 |
| | $D_R$max | 2.25 | 2.30 | 1.90 |
| | Residual Silver (μg/cm$^2$) | 5.1 | 2.0 | 4.1 |
| (4-C) | $D_R$min | 0.15 | 0.12 | 0.12 |
| | $D_R$max | 2.24 | 2.29 | 1.81 |
| | Residual Silver (μg/cm$^2$) | 5.0 | 2.3 | 4.2 |
| (4-D) | $D_R$min | 0.16 | 0.15 | 0.15 |
| | $D_R$max | 2.18 | 1.95 | 1.76 |
| | Residual Silver (μg/cm$^2$) | 5.0 | 4.9 | 4.8 |

Where Samples (1-A), (4-A), (4-B) and (4-C) of the present invention were processed by process (4) of the method of the present invention, the stains were small, the maximum density was high and the amount of the residual silver was small, and excellent photographic characteristics were obtained. In particular, the effect was noticeable in Samples (1-A) and (4-A) each having a silver chlorobromide emulsion having a chloride ion content of 95 mol% or more.

EXAMPLE 5

Plural layers mentioned below were coated on a paper support both surfaces of which were coated with polyethylene, to prepare a multi-layer color photographic paper sample. Coating compositions were prepared as mentioned below.

Preparation of First Layer-Coating Composition 27.2 cc of ethyl acetate and 8.2 g of Solvent (Solv-3) were added to 19.1 g of Yellow Coupler (ExY), 4.4 g of Color Image Stabilizer (Cpd-1) and 0.7 g of Color Image Stabilizer (Cpd-7) and dissolved, and the resulting solution was dispersed by emulsification in 185 cc of a 10 % aqueous gelation solution containing 8 cc of 10 % sodium dodecylbenzenesulfonate. On the other hand, the following two blue sensitive sensitizing dyes were added to a silver chlorobromide emulsion (cubic grains having a mean grain size of 0.88 μm and a grain size distribution variation coefficient of 0.08 and containing 0.2 mol% of silver bromide on the grain surface), each in an amount of $2.0 \times 10^{-4}$ mol, and then the resulting emulsion was sulfur-sensitized. The previously prepared emulsified dispersion and the sulfur-sensitized emulsion were blended to prepare a first layer-coating composition comprising the components mentioned below. The other coating compositions for the second layer to the seventh layer were also prepared in a similar manner. As the gelatin hardening agent for each layer, there was used 1-hydroxy-3,5-dichloro-s-triazine sodium salt.

The following spectral sensitizing dyes were used for the respective layers.

Blue-sensitive Emulsion Layer:

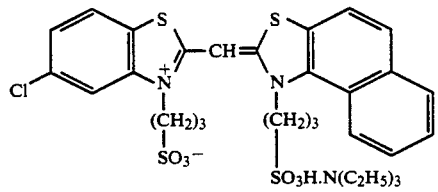

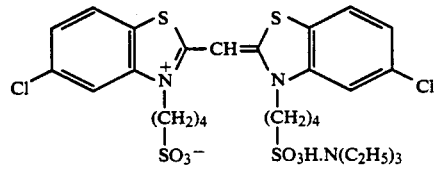

(The above two were incorporated each in an amount of $2.0 \times 10^{-4}$ mol per mol of silver halide in the layer.)

Green-sensitive Emulsion Layer:

-continued

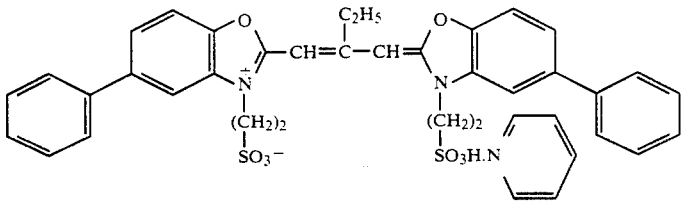

(4.0 × 10−4 mol per mol of silver halide in the layer) and

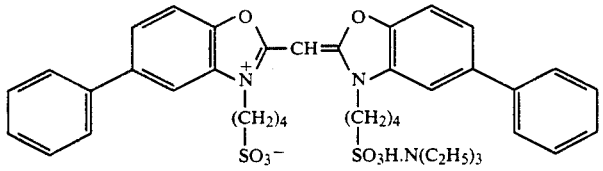

(7.0 × $10^{-5}$ mol per mol of silver halide in the layer)

Red-sensitive Emulsion Layer:

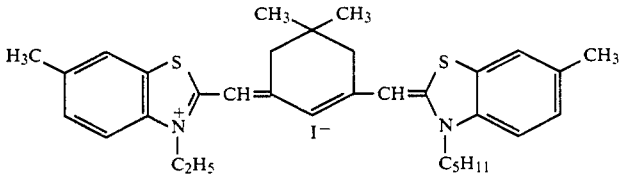

To the red-sensitive emulsion layer was added the following compound in an amount of $2.6\times10^{-3}$ mol per mol of silver halide.

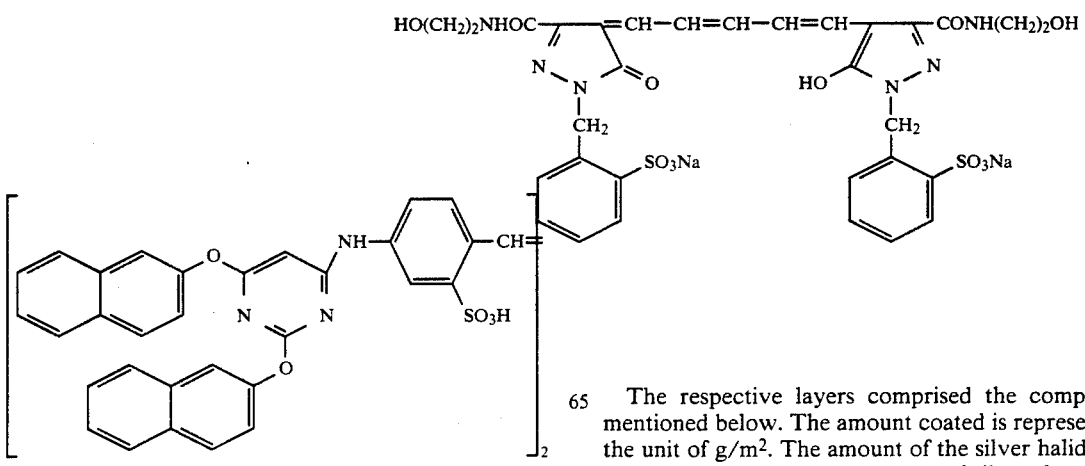

1-(5-Methylureidophenyl)-5-mercaptotetrazole was added to the blue-sensitive emulsion layer, green-sensitive emulsion layer and red-sensitive emulsion layer in an amount of $8.5\times10^{-5}$ mol, $7.7\times10^{-4}$ mol and $2.5\times10^{-4}$ mol, per mol of silver halide, respectively.

The following dyes were added to the emulsion layers for the purpose of anti-irradiation, each in an amount of 4 mg/$m^2$.

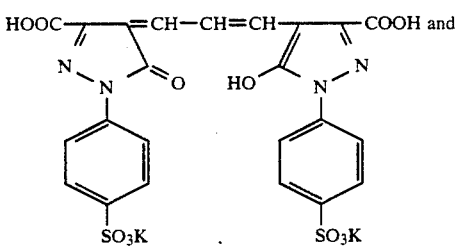

(I-4)

(I-36)

The respective layers comprised the compositions mentioned below. The amount coated is represented by the unit of g/$m^2$. The amount of the silver halide emulsion coated indicates the amount of silver therein.

| Support: | |
|---|---|
| Polyethylene-laminated Paper (containing a white pigment ($TiO_2$) and a blueish dye (ultramarine) in the polyethylene on the side of the first layer) | |
| | Coated Amount |
| First Layer: (Blue-sensitive Emulsion Layer) | |
| Silver Chlorobromide Emulsion | 0.30 |
| Gelatin | 1.86 |
| Yellow Coupler (ExY') | 0.82 |
| Color Image Stabilizer (Cpd-1') | 0.19 |
| Solvent (Solv-3') | 0.35 |
| Color Image Stabilizer (Cpd-7') | 0.06 |
| Second Layer: (Color Mixing Preventing Layer) | |
| Gelatin | 0.99 |
| Color Mixing Preventing Agent (Cpd-5') | 0.08 |
| Solvent (Solv-1') | 0.16 |
| Solvent (Solv-4') | 0.03 |
| Third Layer: (Green-sensitive Emulsion Layer) | |
| Silver Chlorobromide Emulsion (⅓ mixture (by mol of Ag) of cubic grains having a mean grain size of 0.55 μm and a grain size distribution variation coefficient of 0.10 and cubic grains having a mean grain size of 0.39 μm and a grain size distribution variation coefficient of 0.08; both grains containing 0.8 mol % of AgBr locally on the grain surface) | 0.12 |
| Gelatin | 1.24 |
| Magenta Coupler (ExM') | 0.27 |
| Color Image Stabilizer (Cpd-3') | 0.15 |
| Color Image Stabilizer (Cpd-8') | 0.02 |
| Color Image Stabilizer (Cpd-9') | 0.03 |
| Solvent (Solv-2') | 0.54 |
| Fourth Layer: (Ultraviolet Absorbing Layer) | |
| Gelatin | 1.58 |
| Ultraviolet Absorbent (UV-1') | 0.47 |
| Color Mixing Preventing Agent (Cpd-5') | 0.47 |
| Solvent (Solv-5') | 0.24 |
| Fifth Layer: (Red-sensitive Emulsion Layer) | |
| Silver Chlorobromide Emulsion (¼ mixture (by mol of Ag) of cubic grains having a mean grain size of 0.58 μm and grain size distribution variation coefficient of 0.09 and cubic grains having a mean grain size of 0.45 μm and a grain size distribution variation coefficient of 0.11; both grains containing 0.6 mol % of AgBr locally on a part of the grain surface) | 0.23 |
| Gelatin | 1.34 |
| Cyan Coupler (ExC') | 0.32 |
| Color Image Stabilizer (Cpd-6') | 0.17 |
| Color Image Stabilizer (Cpd-10') | 0.04 |
| Color Image Stabilizer (Cpd-7') | 0.40 |
| Solvent (Solv-6') | 0.15 |
| Sixth Layer: (Ultraviolet Absorbing Layer) | |
| Gelatin | 0.53 |
| Ultraviolet Absorbent (UV-1') | 0.16 |
| Color Mixing Preventing Agent (Cpd-5') | 0.02 |
| Solvent (Solv-5') | 0.08 |
| Seventh Layer: (Protective Layer) | |
| Gelatin | 1.33 |
| Acryl-modified Copolymer of Polyvinyl Alcohol (modification degree 17%) | 0.17 |
| Liquid Paraffin | 0.03 |

Compounds used above were as follows:

Yellow Coupler (ExY'):

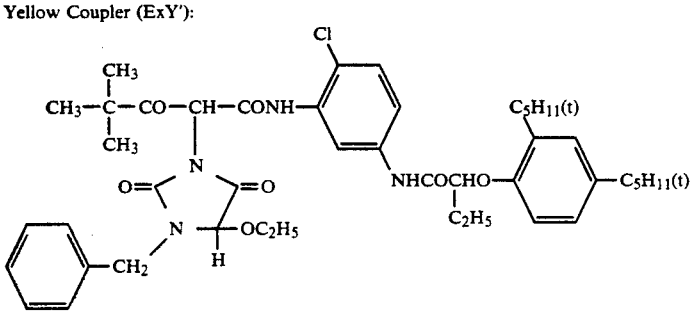

Magenta Coupler (ExM'):

-continued
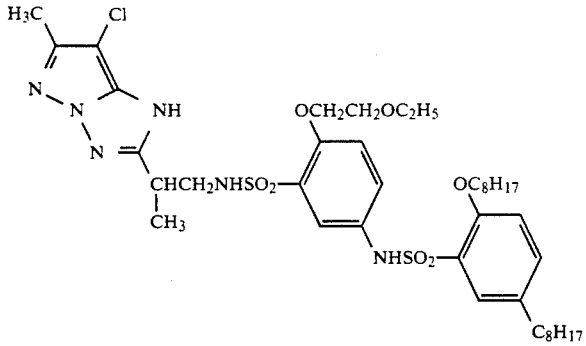
Cyan Coupler (ExC'):
2/4/4 mixture (by weight) of the following compounds:
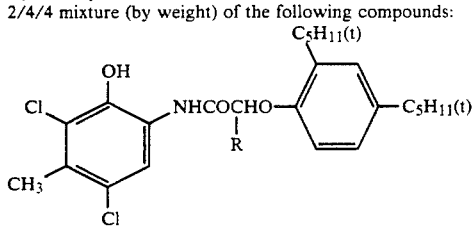
R = $C_2H_5$, $C_4H_9$
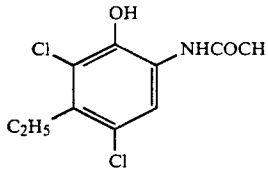
Color Image Stabilizer (Cpd-1'):
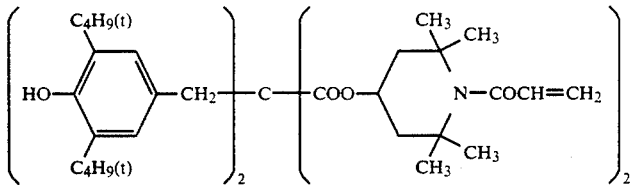
Color Image Stabilizer (Cpd-3'):
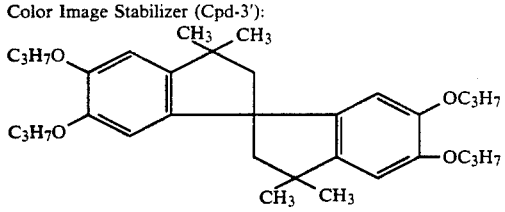
Color Mixing Preventing Agent (Cpd-5'):
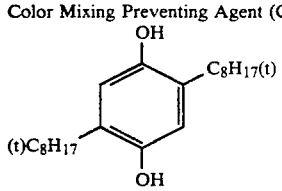
Color Image Stabilizer (Cpd-6'):
2/4/4 mixture (by weight) of the following compounds:
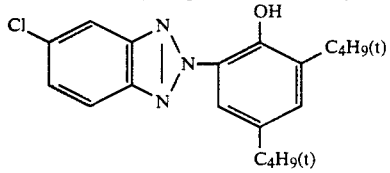

-continued
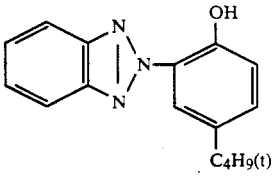
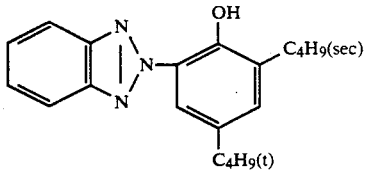
Color Image Stabilizer (Cpd-7'):
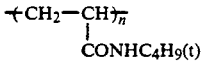
Average molecular weight: 60,000
Color Image Stabilizer (Cpd-8'):
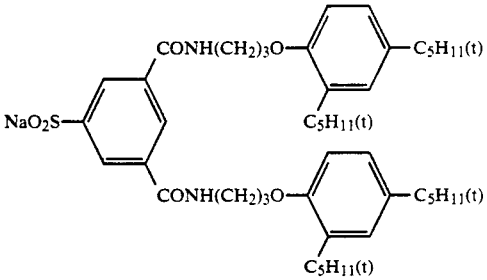
Color Image Stabilizer (Cpd-9'):
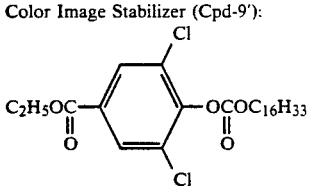
Color Image Stabilizer (Cpd-10'):
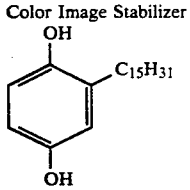
Ultraviolet Absorbent (UV-1'):
4/2/4 mixture (by weight) of the following compounds:
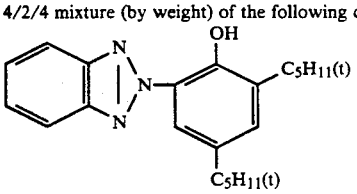
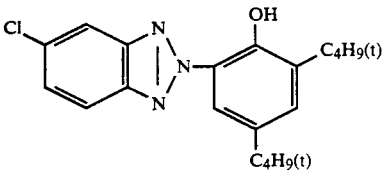

-continued

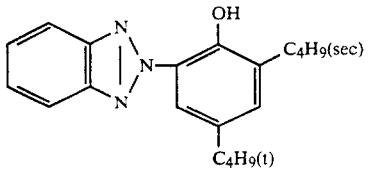

Solvent (Solv-1'):

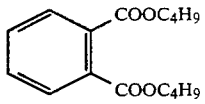

Solvent (Solv-2'):
2/1 mixture (by volume) of the following compounds:

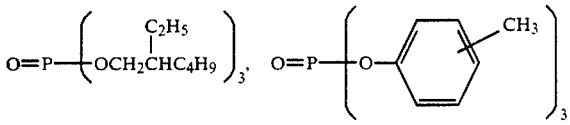

Solvent (Solv-3'):
$O{=}P{+}O{-}C_9H_{19}(iso))_3$

Solvent (Solv-4'):

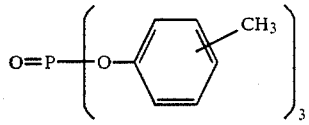

Solvent (Solv-5'):

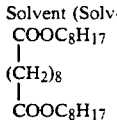

(Solv-6'):

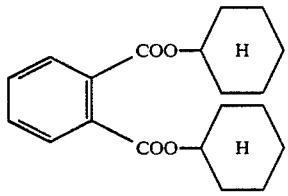

The sample thus prepared was called Sample (5A). Nest, Sample (5B) was prepared in the same manner, except that the same anti-irradiation dye as that used in Sample (1-D) in Example 1 was used.

Samples (5-A) and (5-B) were imagewise exposed and then continuously processed in accordance with the processing steps mentioned below until the amount of the replenisher added to the color developer tank reached three times of the capacity of the developer tank.

| Processing Step | Temp. | Time | Amount of Replenisher (*) | Tank Capacity |
|---|---|---|---|---|
| Color Development | 38 C. | 45 sec | 109 ml | 4 liters |
| Bleach-fixation | 30 to 36° c. | 45 sec | 61 ml | 4 liters |
| Rinsing (1) | 30 to 37° C. | 30 sec | — | 2 liters |
| Rinsing (2) | 30 to 37° C. | 30 sec | — | 2 liters |
| Rinsing (3) | 30 to 37° C. | 30 sec | 364 ml | 2 liters |

-continued

| Processing Step | Temp. | Time | Amount of Replenisher (*) | Tank Capacity |
|---|---|---|---|---|
| Drying | 70 to 85° C. | 60 sec | | |

(*) Per $m^2$ of Sample Processed.

The rinsing was effected by a three-tank countercurrent system from the rinsing tank (3) to the rinsing tank (1). The rinsing solution in the rinsing tank (1) was replenished to the bleach-fixing bath in an amount of 122 ml/$m^2$ of the sample being processed.

The processing solutions used in the above steps were as follows:

| Color Developer: | Tank Solution | Re-plenisher |
|---|---|---|
| Water | 800 ml | 800 ml |
| Ethylenediamine-N,N,N',N'-tetramethylene-phosphonic Acid | 3.0 g | 3.0 g |
| Triethanolamine | 8.0 g | 11.0 g |

-continued

| Color Developer: | Tank Solution | Replenisher |
|---|---|---|
| Sodium Chloride | $4.2 \times 10^{-2}$M | — |
| Potassium Bromide | $1.3 \times 10^{-4}$M | — |
| Potassium Carbonate | 25 g | 25 g |
| N-ethyl-N-(-methanesulfonamidoethyl)-3-methyl-4-aminoaniline Sulfate | 5.0 g | 9.5 g |
| Organic Preservative (III-19) | $2.7 \times 10^{-2}$M | $5.4 \times 10^{-2}$M |
| Brightening Agent (WHITEX-4, manufactured by Sumitomo Chemical Co.) | 1.25 g | 2.5 g |
| Water to make | 1000 ml | 1000 ml |
| pH (25° C.) | 10.05 | 10.60 |

| Bleach-fixing Solution: | Tank Solution | Replenisher |
|---|---|---|
| Water | 400 ml | |
| Ammonium Thiosulfate (70 wt. %) | 100 ml | 250 ml |
| Ammonium Sulfite | 38 g | 95 g |
| Ammonium Ethylenediaminetetraacetate/Iron(III) | 55 g | 138 g |
| Ammonium Bromide | 30 g | 75 g |
| Disodium ethylenediaminetetraacetate | 5 g | 10 g |
| Glacial Acetic Acid | 9 g | 20 g |
| Water to make | 1000 ml | 1000 ml |
| pH (25° C.) | 5.40 | 5.40 |

Rinsing Solution: Tank solution and replenisher were same.

Ion-exchanged Water (Calcium content and magnesium content each was 3 ppm or less.)

In continuous processing, distilled water was added to the color development tank, bleach-fixing tank and rinsing tank each in an amount equal to the amount which was evaporated out from the respective tanks for compensation of the evaporated and concentrated amount.

After the continuous processing, the chloride ion concentration and the bromide ion concentration in the respective color developers were analyzed and, as a result, they were equally as follows:

| | $Cl^-$ | $Br^-$ |
|---|---|---|
| After Continuous Processing of Sample (5-A) | $5.5 \times 10^{-2}$M | $2.0 \times 10^{-4}$M |
| After Continuous Processing of Sample (5-B) | $5.5 \times 10^{-2}$M | $2.0 \times 10^{-4}$M |

Next, Samples (5-A) and (5-B) were sensitometrically exposed in the same manner as in Example 1 and then processed with the respective processing solution. The Values of $D_R$min and $D_R$max and the residual silver amount were measured, which were as follows:

| Sample No. | $D_R$min | $D_R$max | Residual Ag ($\mu g/cm^2$) |
|---|---|---|---|
| 5-A (the Invention) | 0.11 | 2.34 | 0.8 |
| 5-B (Comparative) | 0.18 | 2.28 | 4.9 |

As is obvious from the above-mentioned results, the photographic characteristics of the sample of the present invention (5-A) as processed by the method of the present invention were superior to those of the comparative sample (5-B) as the stains were small, the maximum density is high and the residual silver amount was small.

EXAMPLE 6

Samples (6-A), (6-B), (6-C), (6-D), (6-E) and (6-F) were prepared in the same manner as Sample (5-A) of Example 5, except that the anti-irradiation dyes and the sensitizing dyes were varied as indicated in Table 3 below.

TABLE 3

| Sample | Anti-irradiation Dyes | (Amount Added) | Sensitizing-Dyes: Blue-sensitive Layer | Green-sensitive Layer | Red-sensitive Layer |
|---|---|---|---|---|---|
| (6-A) | 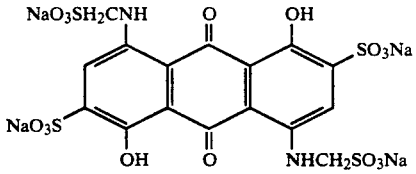 | (8 mg/m²) | VIa-41 | VIb-35<br>VIb-36 | VIa-42 |
| (6-B) | 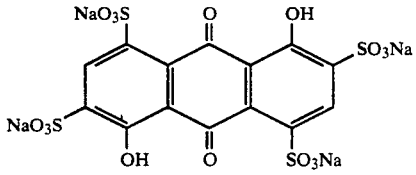 | (8 mg/m²) | VIa-41 | VIb-35<br>VIb-36 | VIa-42 |
| (6-C) | (I-2)<br>(I-4) | (4 mg/m²)<br>(4 mg/m²) | S-A | S-B | S-C |
| (6-D) | (I-36)<br>(I-37) | (4 mg/m²)<br>(4 mg/m²) | S-A | S-B | S-C |
| (6-E) | (I-2)<br>(I-4) | (4 mg/m²)<br>(4 mg/m²) | VIa-41 | VIb-35<br>VIb-36 | VIa-42 |
| (6-F) | (I-36) | (4 mg/m²) | VIa-41 | VIb-35 | VIa-42 |

TABLE 3-continued

| Sample | Anti-irradiation Dyes | (Amount Added) | Sensitizing-Dyes Blue-sensitive Layer | Green-sensitive Layer | Red-sensitive Layer |
|---|---|---|---|---|---|
| | (1-37) | (4 mg/m²) | | VIb-36 | |

S-A

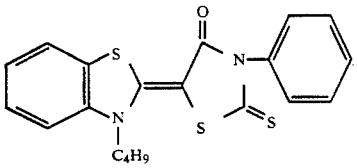

S-B

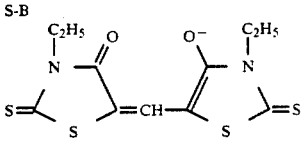

S-C

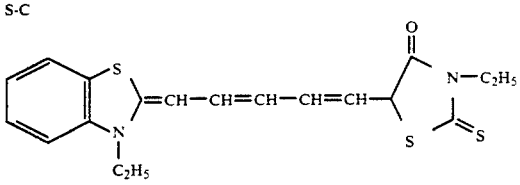

These samples were sensitometrically exposed and then processed with the same processing solution as those used for processing Sample (5-A) in Example 5. The values of $D_B$min, $D_R$max and $D_B$max ($D_B$ is the density of yellow) and the residual silver amount were measured, which were shown in Table 4 below.

TABLE 4

| Sample Code | Remarks | $D_B$min | $D_R$min | $D_B$max | Residual Ag amount (μg/cm²) |
|---|---|---|---|---|---|
| (6-A) | Comparison | 0.15 | 0.17 | 1.95 | 4.8 |
| (6-B) | " | 0.15 | 0.16 | 1.97 | 4.9 |
| (6-C) | Invention | 0.12 | 0.12 | 2.08 | 2.5 |
| (6-C) | " | 0.12 | 0.12 | 2.10 | 2.4 |
| (6-E) | " | 0.10 | 0.11 | 2.15 | 0.9 |
| (6-F) | " | 0.10 | 0.11 | 2.15 | 1.0 |

As is obvious from the above-mentioned results, not only an excellent white background with less yellow stains and cyan stains was obtained, but also the maximum density was high and the residual silver amount was small in the samples of the present invention as processed by the method of the present invention. The effect was especially remarkable in Samples (6-E) and (6-F), each having particularly favorable sensitizing dyes.

While the invention had been described in detail and with reference to specific embodiments thereof, it will be apparent to one skilled in the art that various changed and modifications can be made therein without departing from the spirit and scope thereof.

What is claimed is:

1. A method for processing an imagewise exposed silver halide color photographic material comprising at least one silver halide emulsion layer, which comprises developing said silver halide color photographic material with a color developer containing at least one aromatic primary amine color developing agent, wherein said photographic material contains (a) at least one high silver chloride content emulsion layer with a silver chloride content of 80 mol% or more, and (b) a compound of formula (I):

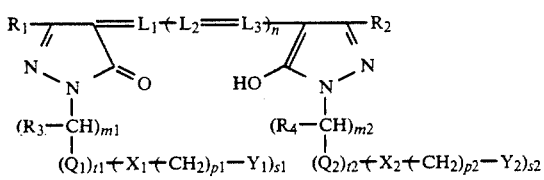

(I)

wherein $R^1$ and $R_2$ each represents —$COOR_5$,

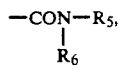

—$COR_5$, —CN or a halogenated methane; $R_3$ and $R_4$ each represents a hydrogen atom or an unsubstituted or substituted alkyl group; $R_5$ and $R_6$ each represents a hydrogen atom, an unsubstituted or substituted alkyl group having 1 to 10 carbon atoms or an unsubstituted or substituted aryl group having 6 to 10 carbon atoms; $Q_1$ and $Q_2$ each represents an unsubstituted or substituted aryl group having 6 to 10 carbon atoms; $X_1$ and $X_2$ each represents a chemical bond or a divalent linking group; $Y_1$ and $Y_2$ each represents a sulfo group or a carboxy group; $L_1$, $L_2$ and $L_3$ each represents a methine group; $m_1$ and $m_2$ each represents 0, 1 or 2; n represents 0, 1 or 2; $p_1$ and $p_2$ each represents 0, 1, 2, 3 or 4; $s_1$ and $s_2$ each represents 1 or 2; and $t_1$ and $t_2$ each represents 0 or 1; provided that the total of $m_1$, $p_1$ and $t_1$ and the total of $m_2$, $p_2$ and $t_2$ must not be 0 at the same time;

and said color developer contains a chloride ion in an amount of from $3.5\times10^{-2}$ to $1.5\times10^{-1}$ mol/liter and a bromide ion in an amount of from $3.0\times10^{-5}$ to $1.0\times10^{-3}$ mol/liter:

wherein the color developer contains an organic preservative which retards the deteriorating speed of the aromatic primary amine color developing agent contained in the developer; and wherein the organic preservative is a compound of formula (II)

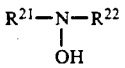

(II)

wherein $R^{21}$ and $R^{22}$ each represents a hydrogen atom, an unsubstituted or substituted alkyl group, an unsubstituted or substituted alkenyl group, an unsubstituted or substituted aryl group or an unsubstituted or substituted hetero-aromatic group, $R^{21}$ and $R^{22}$ must not be hydrogens at the same time, and they may be bonded to each other to form a hetero-ring together with the adjacent nitrogen atom; the cyclic structure of the hetero-ring is 5-membered or 6-membered, and it is composed of carbon, hydrogen, halogen, oxygen, nitrogen and/or sulfur atoms, and may be either saturated or unsaturated.

2. The method according to claim 1, wherein the compound of formula (I) is present in the color photographic material in an amount of from 0.0001 g to 1 g per $m^2$ of the material.

3. The method according to claim 1, wherein the organic preservative is at least one compound selected from a hydroxylamine derivative excluding unsubstituted hydroxylamine, a hydroxamic acid, a hydrazine, a hydrazide, a phenol, an α-hydroxyketone, an α-aminoketone, a saccaride, a monoamine, a diamine, a polyamine, a quaternary ammonium salt, a nitroxy radical, an alcohol, an oxime, a diamide compound, and a condensed ring amine.

4. The method according to claim 1, wherein the organic preservative is present in the color developer in an amount of from 0.005 mol/liter to 0.5 mol/liter.

5. The method according to claim 1, wherein the color developer further contains an organic preservative which is a compound of formula (IV):

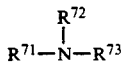

(IV)

wherein $R^{71}$, $R^{72}$ and $R^{73}$ each represents a hydrogen atom, an alkyl group, an alkenyl group, an aryl group, an aralkyl group or a heterocyclic group; and $R^{71}$ and $R^{72}$; $R^{71}$ and $R^{73}$; or $R^{72}$ and $R^{73}$ may be bonded to each other to form a nitrogen-containing hetero-ring; and $R^{71}$, $R^{72}$ and $R^{73}$ may have a substituent.

6. The method according to claim 1, wherein the color photographic material contains at least one sensitizing dye selected from formulae (VIa) or (VIb):

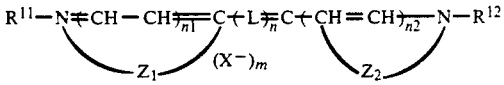

(VIa)

wherein L represents an unsubstituted methine group or a substituted methine group;

$R^{11}$ and $R^{12}$ each represents an unsubstituted alkyl group or a substituted alkyl group;

$Z^1$ and $Z^2$ each represents an atomic group necessary for forming a nitrogen-containing 5-membered or 6-membered heterocyclic nucleus;

X represents an anion;

n represents a numerical value of 1, 3 or 5;

$n_1$ and $n_2$ each represents 0 or 1; when n is 5, both $n_1$ and $n_2$ are 0 and when n is 3, either $n_1$ or $n_2$ is 0; m represents 0 or 1, but m is 0 when the compound forms an inner salt;

when n is 5, the plural L groups may be bonded to each other to form a substituted or unsubstituted 5-membered or 6-membered ring;

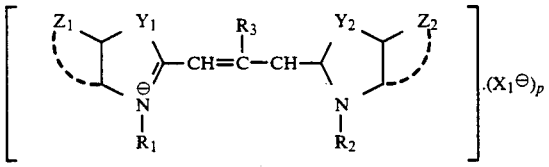

(VIb)

wherein $Z_1$ and $Z_2$ in formula (VIb) each represents an atomic group necessary for forming a benzene or naphthalene ring as condensed to the hetero-ring in the formula, and the condensed heterocyclic ring to be formed may be substituted by a substituent;

$R_1$ and $R_2$ in formula (VIb) each represents an alkyl group, an alkenyl group or an aryl group;

$R_3$ in formula (VIb) represents a hydrogen atom or an alkyl group having from 1 to 3 carbon atoms;

$X_1$- in formula (VIb) represents an anion;

p in formula (VIb) represents 0 or 1; and $Y_1$ and $Y_2$ in formula (VIb) each represents an oxygen atom, a sulfur atom, a selenium atom, a nitrogen atom or a tellurium atom.

* * * * *